US011266887B2

(12) United States Patent
Stokke et al.

(10) Patent No.: US 11,266,887 B2
(45) **Date of Patent: *Mar. 8, 2022**

(54) GOLF CLUB HEADS WITH RIBS AND RELATED METHODS

(71) Applicant: Karsten Manufacturing Corporation, Phoenix, AZ (US)

(72) Inventors: Ryan M. Stokke, Anthem, AZ (US); Martin R. Jertson, Phoenix, AZ (US); David A. Higdon, Phoenix, AZ (US); Xiaojian Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/108,967

(22) Filed: Dec. 1, 2020

(65) Prior Publication Data

US 2021/0077871 A1 Mar. 18, 2021

Related U.S. Application Data

(63) Continuation of application No. 16/571,009, filed on Sep. 13, 2019, now Pat. No. 10,850,172, which is a continuation of application No. 16/133,331, filed on Sep. 17, 2018, now Pat. No. 10,449,427, which is a continuation-in-part of application No. 15/897,023, filed on Feb. 14, 2018, now Pat. No. 10,258,838, which is a continuation of application No. 15/233,715, filed on Aug. 10, 2016, now Pat. No.

(Continued)

(51) Int. Cl.
*A63B 53/04* (2015.01)

(52) U.S. Cl.
CPC ..... *A63B 53/0466* (2013.01); *A63B 53/045* (2020.08); *A63B 53/0408* (2020.08); *A63B 53/0416* (2020.08); *A63B 53/0433* (2020.08); *A63B 53/0437* (2020.08)

(58) Field of Classification Search
CPC ..... A63B 53/0466; A63B 53/045; A63B 53/0408; A63B 53/0416; A63B 53/0433; A63B 53/0437
USPC ..... 473/324–350, 287–292
See application file for complete search history.

(56) References Cited

U.S. PATENT DOCUMENTS

D192,515 S 4/1962 Henrich
4,214,754 A 7/1980 Zebelean
(Continued)

FOREIGN PATENT DOCUMENTS

JP 2001095957 A 4/2001

OTHER PUBLICATIONS

International Search Report and Written Opinion for PCT Application No. PCT/2016/046319, 6 pages, dated Nov. 29, 2016.

*Primary Examiner* — Sebastiano Passaniti

(57) ABSTRACT

Provided herein are embodiments of golf club heads comprising a crown and a ribbed region. The ribbed region of the golf club head can be positioned on a portion of the crown and can further include a ribbed wall, wherein the ribbed wall comprises a ribbed wall interior surface, a ribbed wall exterior surface, and one or more external ribs. The one or more external ribs can protrude from the ribbed region to increase the strength of the crown and beneficially reduce crown thickness. Other embodiments and related methods are disclosed herein.

20 Claims, 17 Drawing Sheets

Related U.S. Application Data

9,925,430, which is a continuation-in-part of application No. 15/186,227, filed on Jun. 17, 2016, now Pat. No. 9,776,056, which is a continuation of application No. 14/260,694, filed on Apr. 24, 2014, now Pat. No. 9,393,465.

(60) Provisional application No. 62/559,097, filed on Sep. 15, 2017, provisional application No. 62/204,373, filed on Aug. 12, 2015, provisional application No. 61/818,832, filed on May 2, 2013.

(56) References Cited

U.S. PATENT DOCUMENTS

| | | | |
|---|---|---|---|
| 5,067,715 | A | 11/1991 | Schmidt et al. |
| D344,772 | S | 3/1994 | Long |
| 5,921,872 | A | 7/1999 | Kobayashi |
| 6,059,669 | A | 5/2000 | Pearce |
| 6,645,087 | B2 | 11/2003 | Yabu |
| 6,776,725 | B1 | 8/2004 | Miura et al. |
| 6,783,465 | B2 | 8/2004 | Matsunaga |
| 6,852,038 | B2 | 2/2005 | Yabu |
| 7,051,416 | B2 | 5/2006 | Yabu |
| 7,108,614 | B2 | 9/2006 | Lo |
| 7,250,007 | B2 | 7/2007 | Lu |
| 7,258,624 | B2 | 8/2007 | Kobayashi |
| 7,258,625 | B2 | 8/2007 | Kawaguchi |
| 7,281,992 | B2 | 10/2007 | Tseng |
| 7,448,964 | B2 | 11/2008 | Schweigert et al. |
| 7,563,177 | B2 | 7/2009 | Jertson |
| 7,641,568 | B2 | 1/2010 | Hoffman et al. |
| 7,798,203 | B2 | 9/2010 | Schweigert et al. |
| 7,861,395 | B2 | 1/2011 | Jorgensen |
| 7,887,433 | B2 | 2/2011 | Hoffman et al. |
| 8,007,369 | B2 | 8/2011 | Soracco |
| 8,172,697 | B2 | 5/2012 | Cackett et al. |
| 8,206,242 | B2 | 6/2012 | Jertson et al. |
| 8,308,582 | B2 | 11/2012 | Tanimoto |
| 8,348,781 | B2 | 1/2013 | Ines |
| 8,360,900 | B2 | 1/2013 | Snyder |
| 8,414,421 | B2 | 4/2013 | Jertson et al. |
| 8,540,590 | B2 | 9/2013 | Tsukada et al. |
| 8,579,728 | B2 | 11/2013 | Morales et al. |
| 8,790,196 | B2 | 7/2014 | Solheim et al. |
| 9,393,465 | B2 | 7/2016 | Stokke et al. |
| 9,421,430 | B2 | 8/2016 | Yamamoto |
| 9,776,056 | B2 | 10/2017 | Stokke et al. |
| 9,925,430 | B2 | 3/2018 | Stokke et al. |
| 10,195,499 | B2 | 2/2019 | Stokke et al. |
| 10,258,838 | B2 | 4/2019 | Stokke et al. |
| 10,449,427 | B2 | 10/2019 | Stokke et al. |
| 10,850,172 | B2 * | 12/2020 | Stokke ..... A63B 53/0466 |
| 2004/0018891 | A1 | 1/2004 | Antonious |
| 2006/0293118 | A1 | 12/2006 | Meyer et al. |
| 2007/0155533 | A1 | 7/2007 | Solheim et al. |
| 2008/0070721 | A1 | 3/2008 | Chen et al. |
| 2008/0132355 | A1 | 6/2008 | Hoffman et al. |
| 2011/0306441 | A1 | 12/2011 | Tsukada et al. |
| 2013/0065705 | A1 | 3/2013 | Morales et al. |
| 2014/0213389 | A1 | 7/2014 | Yamamoto et al. |
| 2015/0018123 | A1 | 1/2015 | Cole |
| 2015/0290503 | A1 | 10/2015 | Su |
| 2015/0298196 | A1 | 10/2015 | Su |

* cited by examiner

GOLF CLUB HEADS WITH RIBS AND RELATED METHODS

CROSS REFERENCE TO RELATED APPLICATIONS

This is a continuation of U.S. patent application Ser. No. 16/571,009, filed on Sep. 13, 2019, now U.S. Pat. No. 10,850,172, which is a continuation of U.S. patent application Ser. No. 16/133,331, filed on Sep. 17, 2018, now U.S. Pat. No. 10,449,427, which is a continuation in part of U.S. patent application Ser. No. 15/897,023, filed Feb. 14, 2018, now U.S. Pat. No. 10,258,838, and claims the benefit of U.S. Provisional Application No. 62/559,097, filed Sep. 15, 2017, which is a continuation of U.S. patent application Ser. No. 15/233,715, now U.S. Pat. No. 9,925,430, filed Aug. 10, 2016, which claims the benefit of U.S. Provisional Application No. 62/204,373, filed Aug. 12, 2015, and is a continuation in part of U.S. patent application Ser. No. 15/186,227, filed Jun. 17, 2016, now U.S. Pat. No. 9,776,056, which is a continuation of U.S. patent application Ser. No. 14/260,694, filed on Apr. 24, 2014, now U.S. Pat. No. 9,393,465, which claims the benefit of U.S. Provisional Application No. 61/818,832, filed on May 2, 2013, the contents of all of which are incorporated fully herein by reference.

TECHNICAL FIELD

The present invention generally relates to golf equipment and, more particularly, to golf club heads.

BACKGROUND

Modern wood-type golf club heads are now almost exclusively made of metal rather than the persimmon wood that gave the clubs their name. These club heads are generally constructed as a hollow metal shell with a relatively thick face to withstand the ball impact and a relatively thick sole to withstand grazing impact with the ground as well as lowering the center of gravity of the club head. The remainder of the club head is manufactured as thin as possible so as to allow the maximum amount of material to be dedicated to the face and sole portions. Although the crown and skirt of a modern club head are quite thin, they still must be sufficiently rigid in the direction of the maximum stress in order to provide support for the face of the club head.

Considering the above, further developments with respect to thinning golf club features while still providing sufficient structural support will enhance the performance of golf clubs.

DESCRIPTION

Figure 1:
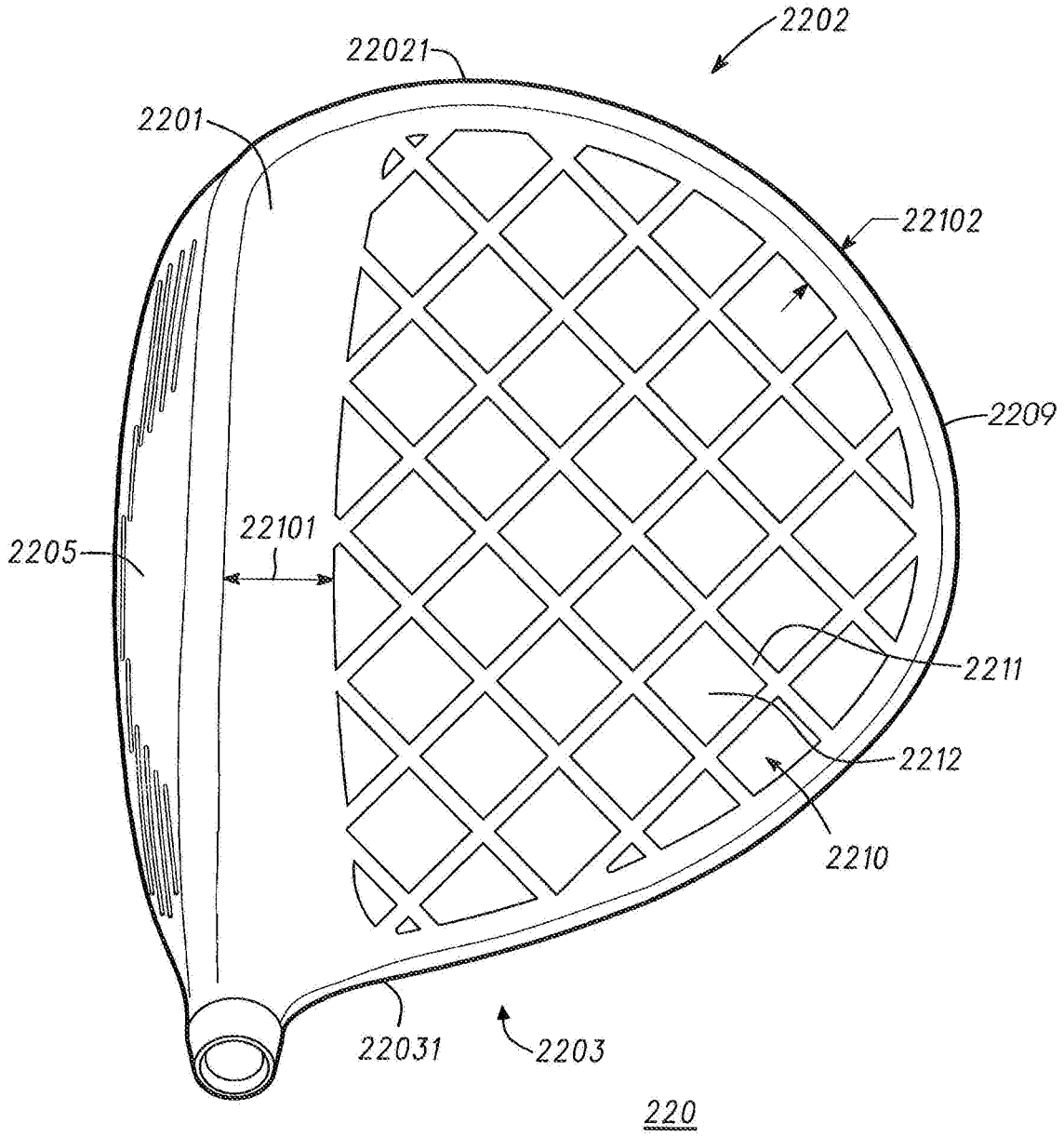
FIG. 1 illustrates a top view of a golf club head according to one embodiment of a golf club head comprising ribbed regions.

Described herein is a golf club head comprising one or more external ribs to provide (1) a visual aid that assists a golfer in aligning a golf ball with a center of a faceplate at an address position, and (2) a thin crown that resists denting due to the resonant forces from golf ball impacts. The one or more external ribs are positioned on any portion of the crown and extend from a front end to a back end of the golf club head. In many embodiments, the one or more external ribs comprises two external ribs positioned at an angle to the faceplate, such that the external rib axes intersect each other external to the golf club head, rearward the faceplate. The one or more external ribs intersect at a common point or are tangent to a locus defined by a conic section perimeter. In other embodiments, the one or more external ribs do not intersect each other and are tangent to a locus defined by a conic section perimeter. The one or more external ribs provide a greater thickness on the crown in portions where the club head is susceptible to large resonant forces. Increasing the crown thickness with the one or more external ribs in portions where the large resonant forces occur allows the crown to be thinned while preventing denting during golf ball impacts.

In one embodiment, a golf club head can comprise a heel portion comprising a heel end; a toe portion comprising a toe end; a sole; a crown; and a ribbed region comprising at least part of at least one of the heel portion, the toe portion, the sole, or the crown. The ribbed region can comprise a ribbed wall comprising a ribbed wall interior surface facing an interior of the golf club head, and a ribbed wall exterior surface facing an exterior of the golf club head opposite the ribbed wall interior surface. The ribbed region can also comprise one or more ribs protruding from the ribbed wall and comprising a first rib comprising a first rib length measured along a rib centerline of the first rib, a first rib interior section, located at the ribbed wall interior surface, and extended along the first rib length, and a first rib exterior section, located at the ribbed wall exterior surface, and extended along the first rib length opposite the first rib interior section.

In one example, a method for providing a golf club head can comprise providing a body comprising a heel portion, a toe portion, a sole, and a crown, and providing a ribbed region comprising a ribbed wall and one or more ribs protruding from the ribbed wall. The ribbed region can be located at least part of at least one of the heel portion, the toe portion, the sole, or the crown. The ribbed wall can comprise a ribbed wall interior surface facing an interior of the golf club head, and a ribbed wall exterior surface facing an exterior of the golf club head opposite the ribbed wall interior surface. The one or more ribs can comprise a first rib comprising a first rib length measured along a rib centerline of the first rib, a first rib interior section, located at the ribbed wall interior surface, and extended along the first rib length, and a first rib exterior section, located at the ribbed wall exterior surface, and extended along the first rib length opposite the first rib interior section.

In one embodiment, a golf club head can comprise a heel portion comprising a heel end, a toe portion comprising a toe end, a sole, a crown, a skirt between the sole and the crown, a faceplate coupled to at least one of the sole or the crown at a club head front end, and a ribbed region comprising at least part of the crown. The ribbed region can comprise a ribbed wall comprising a ribbed wall interior surface facing an interior of the golf club head, a ribbed wall exterior surface facing an exterior of the golf club head opposite the ribbed wall interior surface, and a ribbed wall thickness of approximately 0.38 mm to approximately 0.76 mm between the ribbed wall interior surface and the ribbed wall exterior surface. The ribbed region can also comprise ribs protruding from the ribbed wall and comprising a first rib comprising: a first rib length measured along a rib centerline of the first rib, a first rib interior section, protruding from the ribbed wall interior surface by approximately 0.25 mm to approximately 1.27 mm throughout the first rib length, and a first rib exterior section, protruding from the ribbed wall exterior surface by approximately 0.25 mm to approximately 1.27 mm and opposite the first rib interior section throughout the first rib length.

Other examples and embodiments are further disclosed herein. Such examples and embodiments may be found in the figures, in the claims, and/or in the present description.

Figure 2:
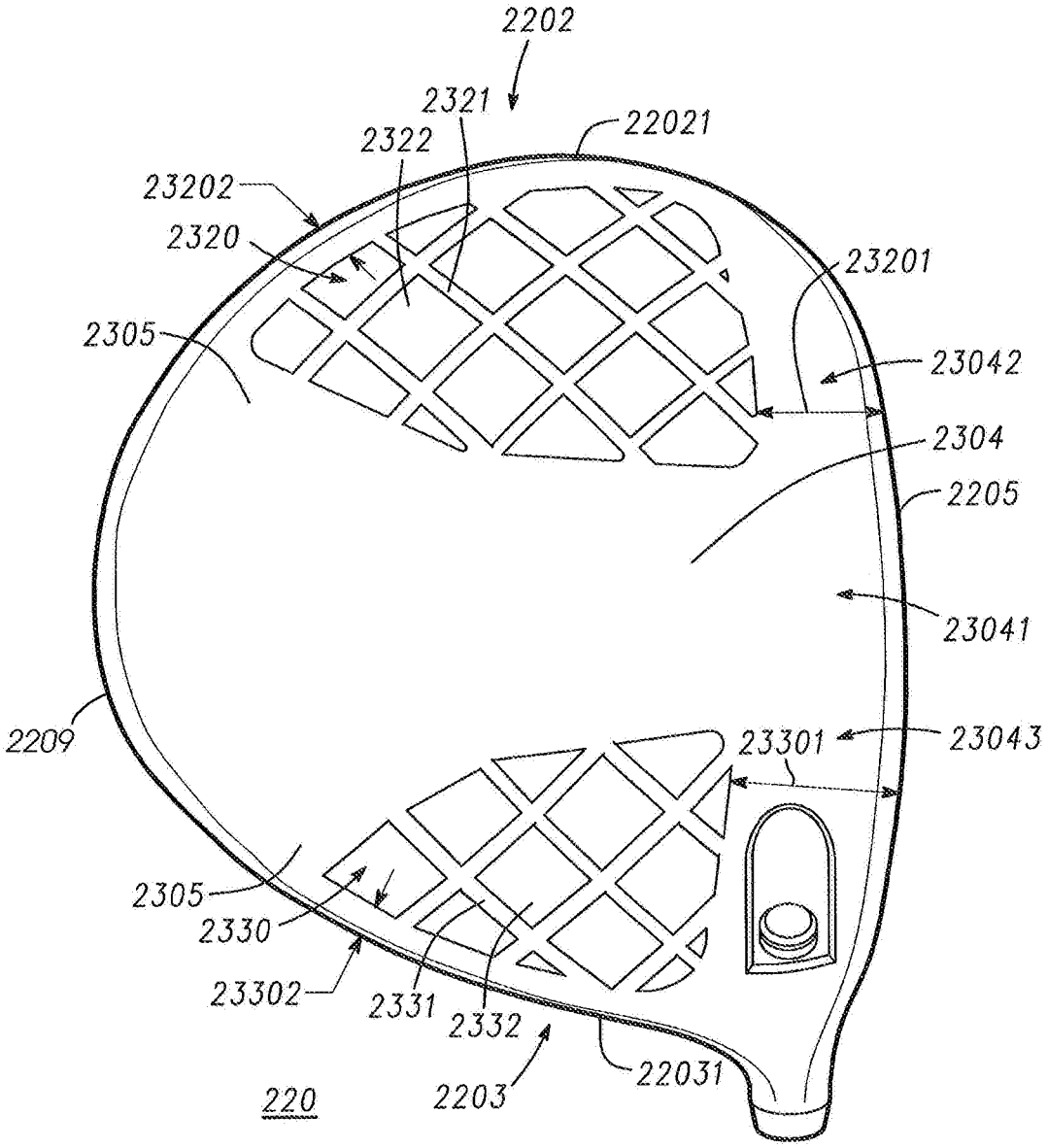
FIG. 2 illustrates a bottom view the golf club head of FIG. 1.
Figure 3:
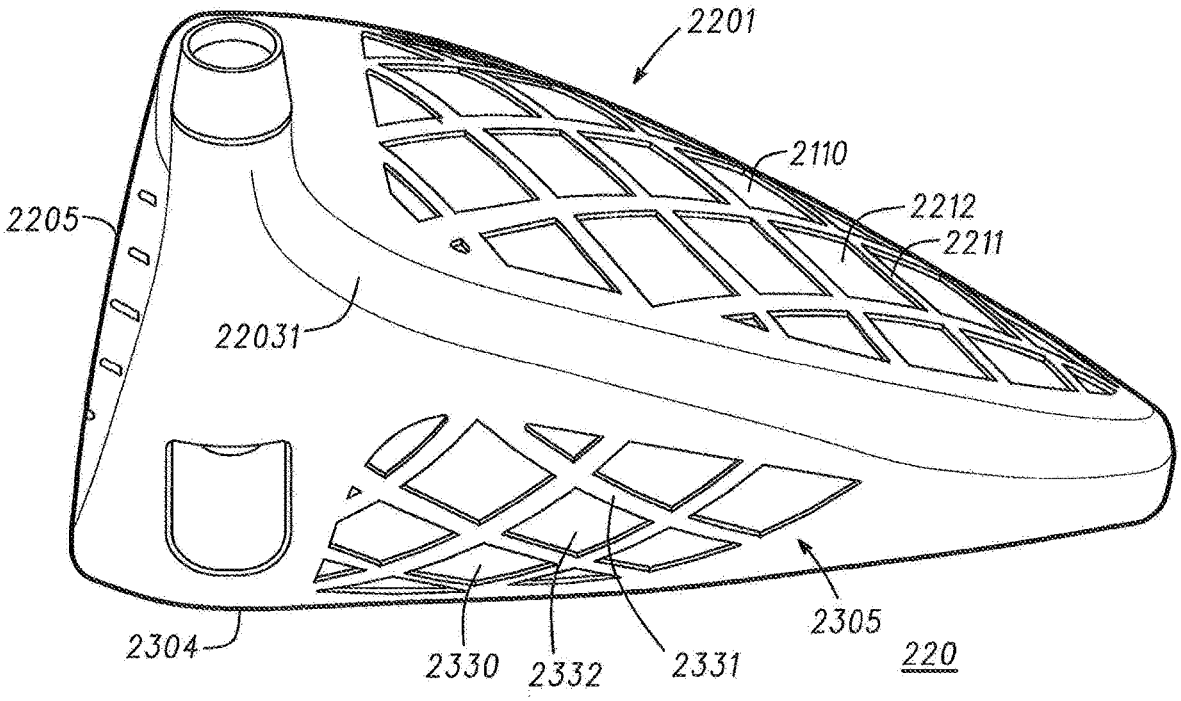
FIG. 3 illustrates a side view the golf club head of FIG. 1.

FIG. 1 illustrates a top view of golf club head 220. FIG. 2 illustrates a bottom view of golf club head 220. FIG. 3 illustrates a side view of golf club head 220.

Golf club head 220 comprises crown 2201, sole 2304, and faceplate 2205 coupled to at least one of sole 2304 or crown 2201 at a front end of golf club head 220. Golf club head 220 also has skirt 2305 in the present example, located between crown 2201 and sole 2304. Golf club head 220 comprises ribbed regions 2210, 2320, and 2330, where ribbed region 2210 comprises at least part of crown 2201, and where ribbed regions 2320 and 2330 comprise at least part of sole 2304 of golf club head 220. Ribbed regions 2320 and 2330 also extend to at least part of skirt 2305 in the present example. There can be other examples, however, where ribbed regions 2320 and/or 2330 can be limited to sole 2304 without extending to skirt 2305. Similarly, skirt 2305 can be optional.

In some embodiments, the golf club head 220 can comprise a front distance 22101 measured from the faceplate 2250 to the ribbed region 2210. The front distance 22101 can be 12.7 mm to 76.4 mm. In other embodiments, the golf club head 220 can comprise a front distance 23201 and/or front distance 23310 measured from the faceplate 2250 to the ribbed regions 2320 and/or 2330. The front distance 23201/23310 can 12.7 mm to 76.4 mm. In the same or other embodiments, the golf club head 220 can comprise a rear distance 22102 measured from a club head edge 2209 to the ribbed region 2210. The rear distance 22102 can be 2.54 mm 12.7 mm, In the same or other embodiments, the golf club head 220 can comprise a rear distance 23202 and or a rear distance 23302 measured form the edge of the club head 2209 to the ribbed regions 2320 and/or 2330. The rear distance 23202/23303 can 2.54 mm to a 12.7 mm. Club head edge 2209 can be defined along a perimeter of the heel portion, toe portion, and/or back end of golf club head 220 with respect to a top view (FIG. 1) and/or a bottom view (FIG. 2) of golf club head 220.

In the present example, sole 2304 comprises sole thick region 23041 located between heel portion 2203 and toe portion 2202 of golf club head 220. Sole 2304 also comprises sole-heel region 23043 located between sole thick region 23041 and heel end 22031, and sole-toe region 23042 located between sole thick region 23041 and toe end 22021 of golf club head 220. Sole thick region 23041 can have a thickness of approximately 0.5 mm to approximately 6.35 mm, where such thickness can be substantially constant or can be varied across sole thick region 23041 to position mass of golf club head 220 for improved performance and/or for structural integrity. Ribbed regions 2320 and 2330 are located outside sole thick region 23041, where ribbed region 2320 comprises at least part of sole-toe region 23042, and where ribbed region 2330 comprises at least part of sole-heel region 23043. There can be other embodiments, however, where sole 2304 lacks sole thick region 23041 between sole-toe region 23042 and sole-heel region 23043. In such embodiments, ribbed regions 2330 and 2340 may thus further extend towards each other and/or merge together at sole 2304.

Ribbed regions 2210, 2320, and 2330 comprise respective one or more ribs 2211, 2321, and 2331, and respective ribbed walls 2212, 2322, and 2332 in the present example. In the present embodiment, ribbed wall 2212 of ribbed region 2210 is thinner than the cross-sectional thickness of crown 2201 outside ribbed region 2210. Similarly, ribbed walls 2322 and 2332 of respective ribbed regions 2320 and 2330 are thinner than the cross-sectional thickness of sole thick region 23041 and other parts of sole 2304 outside ribbed regions 2320 and 2330. The reduced thickness of ribbed walls 2212, 2322, and 2332 permit a reduction of mass at respective ribbed regions 2210, 2320, and 2330, where such reduction in mass can be advantageous for making golf club head 220 lighter if desired, and/or for repositioning mass to other areas of golf club head 220 for better performance without increasing the total mass of golf club head 220.

Figure 4:
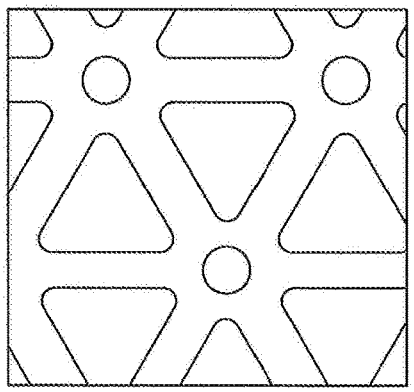
FIG. 4 illustrates an isogrid pattern suitable for one or more ribbed regions of a golf club head similar to the golf club head of FIG. 1.

The one or more ribs 2211, 2321, and 2331 can be arranged to reinforce golf club head 220 where respective ribbed regions 2210, 2320, and 2330 are located. Ribs 2211, 2321, and 2331 are arranged in a diamond-grid pattern in the present example, where each diamond of the diamond-grid pattern is a square. Other arrangements are possible, however, for the one or more ribs 2211, 2321, and/or 2331. For example, one arrangement can comprise a diamond-grid pattern with one or more diamonds comprising a parallelogram different than a square, such as a rectangle, rhomboid, or rhombus, and/or other diamond shape(s). Other arrangements can comprise one or more polygonal shapes comprising triangles, pentagons, hexagons, and/or other polygons. Furthermore, in some embodiments, only complete shapes are used in the arrangement, while in other embodiments portions of the shapes are used at the perimeter of the arrangement and/or at other portions of the arrangement. Also, other arrangements can use two or more shapes. One embodiment can comprise a pattern similar to the isogrid pattern shown in FIG. 4. There can also be arrangements where one or more ribs can be curved. Furthermore, ribs 2211, 2321, and 2331 can comprise a plurality of ribs, there can be embodiments where ribs 2211, 2321, and/or 2331 of ribbed regions 2210, 2320, and/or 2330 can comprise or be described to comprise a single rib.

The ribbed regions can comprise ribs that can correspond to one or more ribs of ribs 2211, 2321, and/or 2331.

Figure 5:
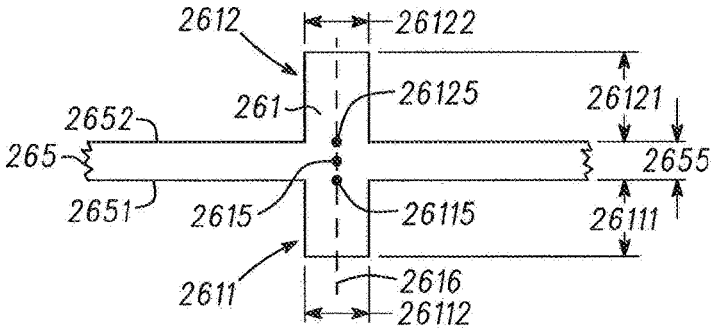
FIG. 5 illustrates a transverse cross-sectional view of a golf club head ribbed region.
Figure 6:
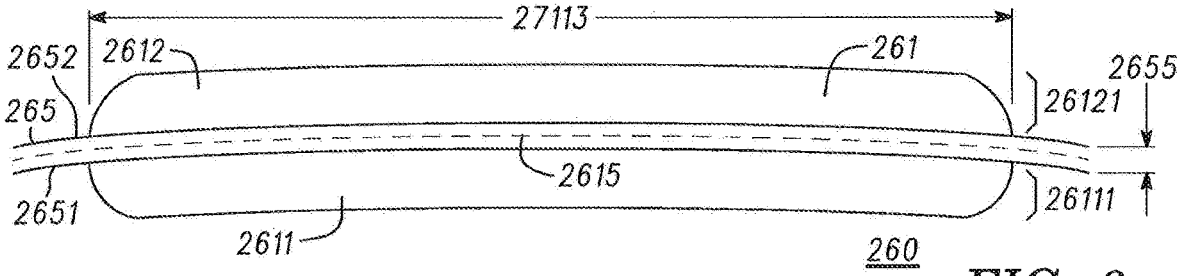
FIG. 6 illustrates a longitudinal cross-sectional view of the ribbed region of FIG. 5.

FIG. 5 illustrates a transverse cross-sectional view of ribbed region 260. FIG. 6 illustrates a longitudinal cross-sectional view of ribbed region 260. In one example ribbed region 260 comprises ribbed wall 265, which can correspond to ribbed wall 2212 of ribbed region 2210 (FIG. 1), to ribbed wall 2322 of ribbed region 2320 (FIG. 2), and/or to ribbed wall 2332 of ribbed region 2330 (FIG. 2). Ribbed wall 265 comprises ribbed wall interior surface 2651 and ribbed wall exterior surface 2652 opposite each other, where ribbed wall interior surface 2651 and ribbed wall exterior surface 2652 can respectively face an interior or an exterior of a golf club head like golf club head 220.

Ribbed region 260 also comprises rib 261 protruding from ribbed wall 265, where rib 261 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). As can be seen in the longitudinal cross-sectional view of FIG. 6, rib 261 comprises rib length 27113 from end-to-end thereof, where rib length 27113 extends along rib centerline 2615 of rib 261, and where rib centerline 2615 traverses along the center of rib 261 within ribbed wall 265.

In the present example, rib 261 comprises rib interior section 2611 located at ribbed wall interior surface 2651, and rib exterior section 2612 located at ribbed wall exterior surface 2652. Rib interior section 2611 comprises rib interior height 26111 and rib interior width 26112, and extends along rib exterior section centerline 26125 parallel to rib centerline 2615. Rib exterior section 2612 comprises rib exterior height 26121 and rib interior width 26122, and extends along rib interior section centerline 26115 parallel to rib centerline 2615. Rib interior section 2611 and rib exterior section 2612 are thus aligned with rib centerline 2615.

Rib 2615 comprises rib centerplane 2616, which extends along rib centerline 2615 substantially orthogonal to ribbed wall 265. In the present example, rib interior section 2611 and rib exterior section 2612 are collinear to each other, where rib exterior section centerline 26125 and rib interior section centerline 26115 both extend along rib centerplane 2616.

Figure 15:
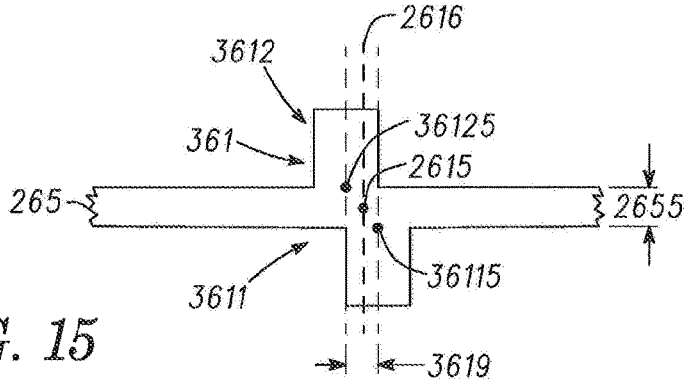
FIG. 15 illustrates a transverse cross-sectional view of another golf club head ribbed region.

There can be other examples, however, where the rib interior and exterior sections of a rib can be offset from each other rather than collinear. Skipping to FIG. 15, a transverse cross-sectional view of ribbed region 360 is illustrated therein. Ribbed region 360 comprises rib 361, which can be similar to rib 261 or ribbed region 260 (FIG. 1). Rib 361 comprises rib centerplane 2616 extended along rib centerline 2615. Rib 361 also comprises rib exterior section 3612 extended along rib exterior section centerline 36125 parallel to rib centerline 2615, and rib interior section 3611 extended along rib interior section centerline 36115 parallel to rib centerline 2615. Rib exterior section 3612 and rib interior section 3611 are both traversed by rib centerplane 2616, but rib exterior section centerline 36125 and rib interior section centerline 36115 are offset from rib centerline 2615. In the present example, offset distance 3619 between rib exterior section centerline 36125 and rib interior section centerline 36115, measured orthogonal to rib centerline 2616, can be up to 5.08 mm.

Backtracking to the example of FIG. 1, each of rib interior section 2611 and rib exterior section 2612 can extend along rib length 27113 in a substantially consistent manner, where rib interior section 2611 protrudes past ribbed wall interior surface 2651 throughout rib length 27113, where rib exterior section 2612 protrudes past ribbed wall exterior surface 2652 throughout rib length 27113, and where rib interior height 26111 and rib exterior height 26121 remain substantially constant along a majority of rib length 27113. There can be other examples, however, where rib interior height 26111 and/or rib exterior height 26121 can vary along rib length 27113. Similarly, there can be other examples where rib interior width 26112 and/or rib exterior width 26122 can vary along rib length 27113.

Ribbed wall 265 comprises ribbed wall thickness 2655 between ribbed wall interior surface 2651 and ribbed wall exterior surface 2652, where ribbed wall thickness 2655 is approximately 0.38 mm to approximately 0.76 mm in the present embodiment but can be approximately 0.13 mm to approximately 1.27 mm in the same or other embodiments. In the same or other embodiments, rib interior height 26111 and/or rib exterior height 26121 of rib 261 can be up to approximately 2.5 mm. For instance, rib interior height 26111 and/or rib exterior height 26121 of rib 261 can be approximately 0.25 mm to approximately 1.27 mm in some implementations. In the same or other embodiments, rib interior width 26112 and/or rib exterior width 26122 of rib 261 can be up to approximately 5.1 mm. For instance, rib interior width 26112 and/or rib exterior width 26122 of rib 261 can be approximately 0.38 mm to approximately 3.81 mm in some implementations.

Figure 7:
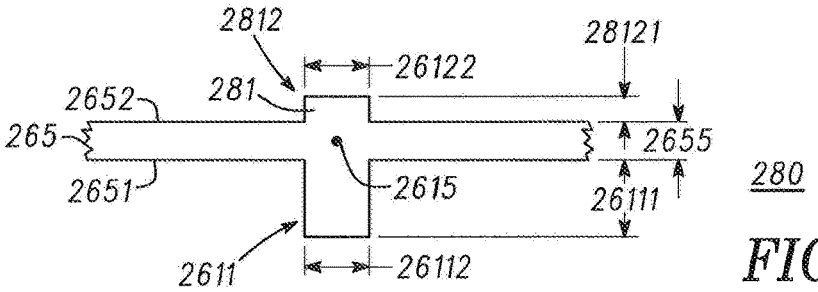
FIG. 7 illustrates a transverse cross-sectional view of another golf club head ribbed region.
Figure 8:
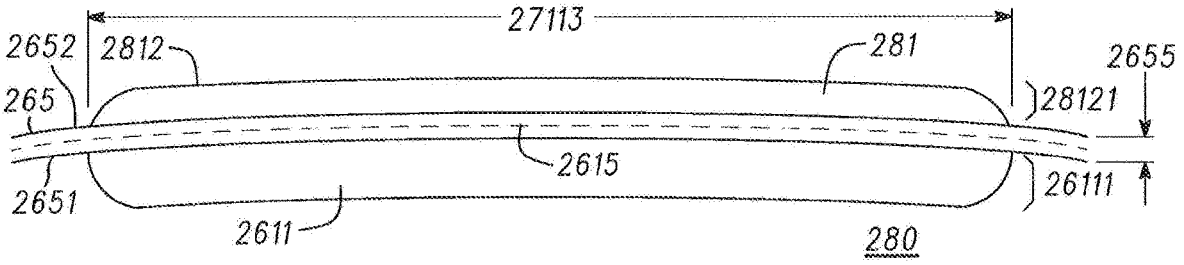
FIG. 8 illustrates a longitudinal cross-sectional view of the ribbed region of FIG. 7.

FIG. 7 illustrates a transverse cross-sectional view of ribbed region 280. FIG. 8 illustrates a longitudinal cross-sectional view of ribbed region 280. Ribbed region 280 comprises ribbed wall 265. Ribbed region 280 also comprises rib 281 protruding from ribbed wall 265, where rib 281 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). In the present example, rib 281 comprises rib interior section 2611 located at ribbed wall interior surface 2651, and rib exterior section 2812 located at ribbed wall exterior surface 2652.

Rib 281 can be similar to rib 261 in many respects, but can differ with respect to the rib interior and exterior heights. Although in some examples, rib interior height 26111 and rib exterior height 26121 of rib 261 are substantially equal to each other, corresponding heights for rib 281 can differ from each other. For instance, rib interior section 2611 of rib 281 comprises rib interior height 26111, while rib exterior section 2812 comprises rib exterior height 28121, where rib interior height 26111 of rib interior section 2611 is greater than rib exterior height 28121 of rib exterior section 2812. Rib exterior height 28121 can be approximately 0.51 mm and rib interior height 26111 can be greater than 0.76 mm in the present example, but there can be embodiments where rib exterior height 28121 can be approximately 0.25 mm to approximately 0.76 mm. Other features of rib 281 can be similar to corresponding features of rib 261 as described above. For example, rib 281 is aligned with rib centerline 2615 and extending along rib length 27113 in a substantially consistent manner, where rib interior section 2611 protrudes past ribbed wall interior surface 2651 throughout rib length 27113, where rib exterior section 2812 protrudes past ribbed wall exterior surface 2652 throughout rib length 27113, and where rib interior height 26111 and rib exterior height 28121 remain substantially constant along a majority of rib length 27113. There can be other examples, however, where rib interior height 26111 and/or rib exterior height 28121 can vary along rib length 27113. Similarly, there can be other examples where rib interior width 26112 and/or rib exterior width 26122 can vary along rib length 27113.

Figure 9:
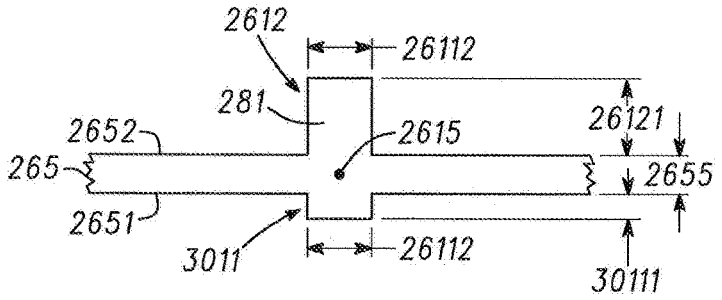
FIG. 9 illustrates a transverse cross-sectional view of another golf club head ribbed region.
Figure 10:
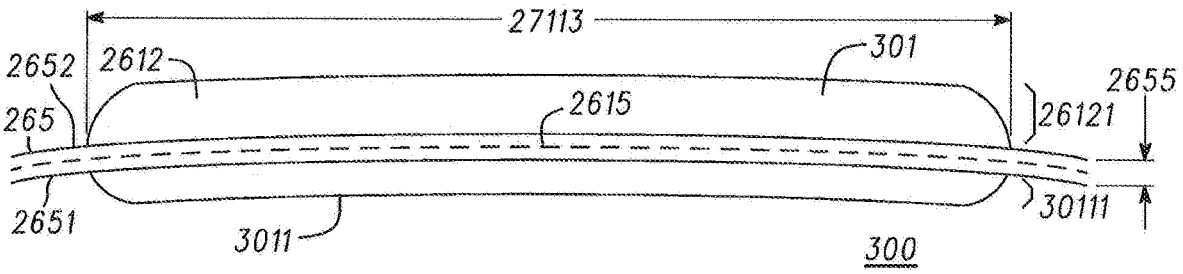
FIG. 10 illustrates a longitudinal cross-sectional view of the ribbed region of FIG. 9.

FIG. 9 illustrates a transverse cross-sectional view of ribbed region 300. FIG. 10 illustrates a longitudinal cross-sectional view of ribbed region 300. Ribbed region 300 comprises ribbed wall 265. Ribbed region 300 also comprises rib 301 protruding from ribbed wall 265, where rib 301 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). In the present example, rib 301 comprises rib interior section 3011 located at ribbed wall interior surface 2651, and rib exterior section 2612 located at ribbed wall exterior surface 2652.

Rib 301 can be similar to rib 261 (FIGS. 5-6) and to rib 281 (FIGS. 7-8) in many respects, but can differ with respect to rib interior and exterior heights. In the present example, rib interior section 3011 of rib 301 comprises rib interior height 30111, while rib exterior section 2612 comprises rib exterior height 26121, where rib exterior height 26121 of rib exterior section 2612 is greater than rib interior height 30111 of rib interior section 3011.

Rib interior height 30111 can be approximately 0.51 mm and rib exterior height 26121 can be greater than 0.76 mm in the present example, but there can be embodiments where rib interior height 30111 can be approximately 0.25 mm to approximately 0.76 mm.

Other features of rib 301 can be similar to corresponding features of rib 261 and/or 281 as described above. For example, rib 301 extends in alignment with rib centerline 2615 and along rib length 27113 in a substantially consistent manner, where rib interior section 3011 protrudes past ribbed wall interior surface 2651 throughout rib length 27113, where rib exterior section 2612 protrudes past ribbed wall exterior surface 2652 throughout rib length 27113, and where rib interior height 30111 and rib exterior height 26121 remain substantially constant along a majority of rib length 27113. There can be other examples, however, where rib interior height 30111 and/or rib exterior height 26121 can vary along rib length 27113. Similarly, there can be other examples where rib interior width 26112 and/or rib exterior width 26122 can vary along rib length 27113.

Figure 11:
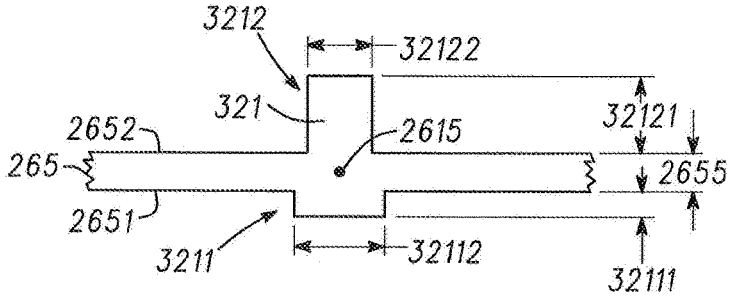
FIG. 11 illustrates a transverse cross-sectional view of another golf club head ribbed region.

FIG. 11 illustrates a transverse cross-sectional view of ribbed region 320, which comprises rib 321 protruding from ribbed wall 265, where rib 321 can correspond to one of the one or more ribs 2211 of ribbed region 2210 (FIG. 1), to one or the one or more ribs 2321 of ribbed region 2320 (FIG. 2), and/or to one of the one or more ribs 2331 of ribbed region 2330 (FIG. 2). In the present example, rib 321 comprises rib interior section 3211 located at ribbed wall interior surface 2651, and rib exterior section 3212 located at ribbed wall exterior surface 2652.

Rib 301 can be similar to rib 261, to rib 281, and/or to rib 301 in many respects, but can differ with respect to rib interior and exterior heights and/or widths. In the present example, rib interior section 3211 of rib 321 comprises rib interior height 32111 and rib interior width 32112, while rib exterior section 3212 comprises rib exterior height 32121 and rib exterior width 32122. In some examples, rib interior height 32111 can comprise a height range similar to that for rib interior height 26111 or rib interior height 30111, while rib exterior height 32121 can comprise a height range similar to that of rib exterior height 26121 or rib exterior height 28121. In the same or other examples, rib interior width 32112 can comprise a width range similar to or smaller than that for rib interior width 26112, while rib exterior width 32122 can comprise a width range similar to or larger than that for rib exterior width 26122.

As seen in FIG. 11, rib exterior height 32121 of rib exterior section 3212 can be greater than rib interior height 32111 of rib interior section 3211. In addition, rib interior width 32112 of rib interior section 3211 can be greater than rib exterior width 32122 of rib exterior section 3212. For example, rib interior width 32112 can be approximately 0.76 mm to approximately 1.9 mm while rib exterior width 32122 can be less than 0.76 mm.

There also can be examples with different rib height or width arrangements. For instance, in one embodiment, rib exterior width 32122 for rib exterior section 3212 can, instead, be greater than rib interior width 32112 for rib interior section 3211. For instance, rib exterior width 32122 can be approximately 0.76 mm to approximately 1.9 mm while rib interior width 32112 can be less than 0.76 mm. In the same or other embodiments, rib interior height 30111 for rib interior section 3211 can, instead, be greater than rib exterior height 32121 for rib exterior section 3212.

Figure 12:
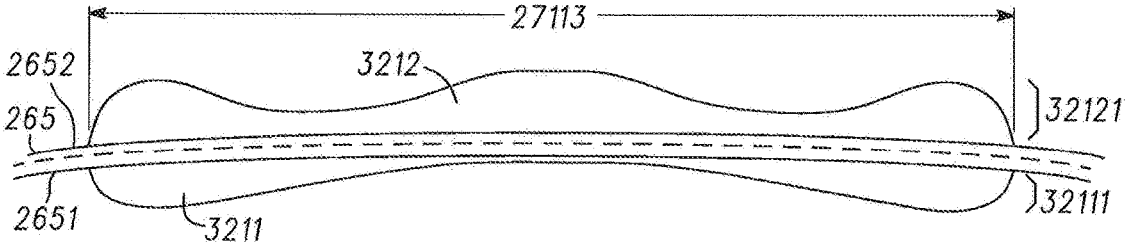
FIG. 12 illustrates a longitudinal cross-sectional view of the ribbed region of FIG. 11.

In the present embodiment, rib 301 extends aligned with rib centerline 2615 and along rib length 27113 in a varying manner as seen in FIG. 12, where each of interior rib height 32111 and exterior rib height 32121 varies along rib length 27113. There also can be embodiments, however, where only one of interior rib height 32111 or exterior rib height 32121 varies along rib length 27113. Nevertheless, there also can be embodiments where rib 301 can extend along rib length 27113 in a substantially consistent manner as described above with respect to rib 261, rib 281, and/or 301.

In another embodiment of the golf club head 220, as illustrated in FIGS. 16-19, ribbed region 2210 is positioned on a portion of the crown 2201 and can comprise a ribbed wall 2212. The ribbed wall 2212 is measured from and comprises a ribbed wall interior surface 225 and a ribbed wall exterior surface 224 opposite the ribbed wall interior surface 225. The ribbed wall is less than 0.8 mm, less than 0.7 mm, less than 0.6 mm, less than 0.5 mm, less than 0.4 mm, or less than 0.3 mm. The ribbed wall interior surface 225 faces an interior of the golf club head 220 and the ribbed wall exterior surface 224 faces an exterior of the golf club head 220. The ribbed region 2210 further comprises one or more external ribs 222 protruding from the ribbed wall exterior surface 224 and one or more internal ribs 223 protruding from the ribbed wall interior surface 225. The one or more external ribs 222 and the one or more internal ribs 223 provide structural support to the golf club head 220. The one or more external ribs 222 and the one or more internal ribs 223 form external thin portions 228 and internal thin portions 229 that can provide weight reduction of golf club head 220. Further, the one or more internal ribs 223 can improve the casting ability of golf club head 220.

The golf club head 220 can further comprise a front distance 22101 measured from the top of the faceplate 2250 to the ribbed region 2210 and a rear distance 22102 measured from a club head edge 2209 to the ribbed region 2210. The club head edge 2209 can be defined along a perimeter of the heel portion 2203, the toe portion 2202, and/or the back end 234 of golf club head 220 with respect to a top view (FIG. 1) and/or a bottom view (FIG. 2) of the golf club head 220. The front distance 22101 and the rear distance 22102 of the ribbed region 2210 can be constant from the one or more external ribs 222/internal ribs 223 to a consecutive rib of the one or more external ribs 222/internal ribs 223. In other examples, the distance 22101 and the distance 22102 of the ribbed region 2210 can vary from a heel portion to the toe portion. For example, the one or more external rib 222 closest to the toe portion 2202 can have a rear distance 22102 greater than the remaining one or more external ribs 222. The front distance 22101 can range from 10 mm to 40 mm, 10 mm to 20 mm, 20 mm to 30 mm, or 30 mm to 40 mm (e.g., 10 mm, 14 mm, 18 mm, 22 mm, 26 mm, 30 mm, 34 mm, 38 mm, or 40 mm). In other examples, the front distance 22101 can range from 12.7 mm to 76.4 mm, 12.7 to 25 mm, 25 mm to 40 mm, 40 mm to 55 mm, 55 mm to 70 mm, or 70 mm to 76.4 mm. For example, the distance 22101 can be 12.7 mm, 20 mm, 30 mm, 40 mm, 50 mm, 60 mm, or 76.4 mm. The rear distance 22102 of the ribs can range from 1 mm to 26 mm, 1 mm to 10 mm, 5 mm to 15 mm, 10 mm to 18 mm, or 18 mm to 26 mm (e.g., up to 1 mm, up to 4 mm, up to 8 mm, up to 12 mm, up to 16 mm, up to 20 mm, up to 24 mm, or up to 26 mm).

Figure 20:
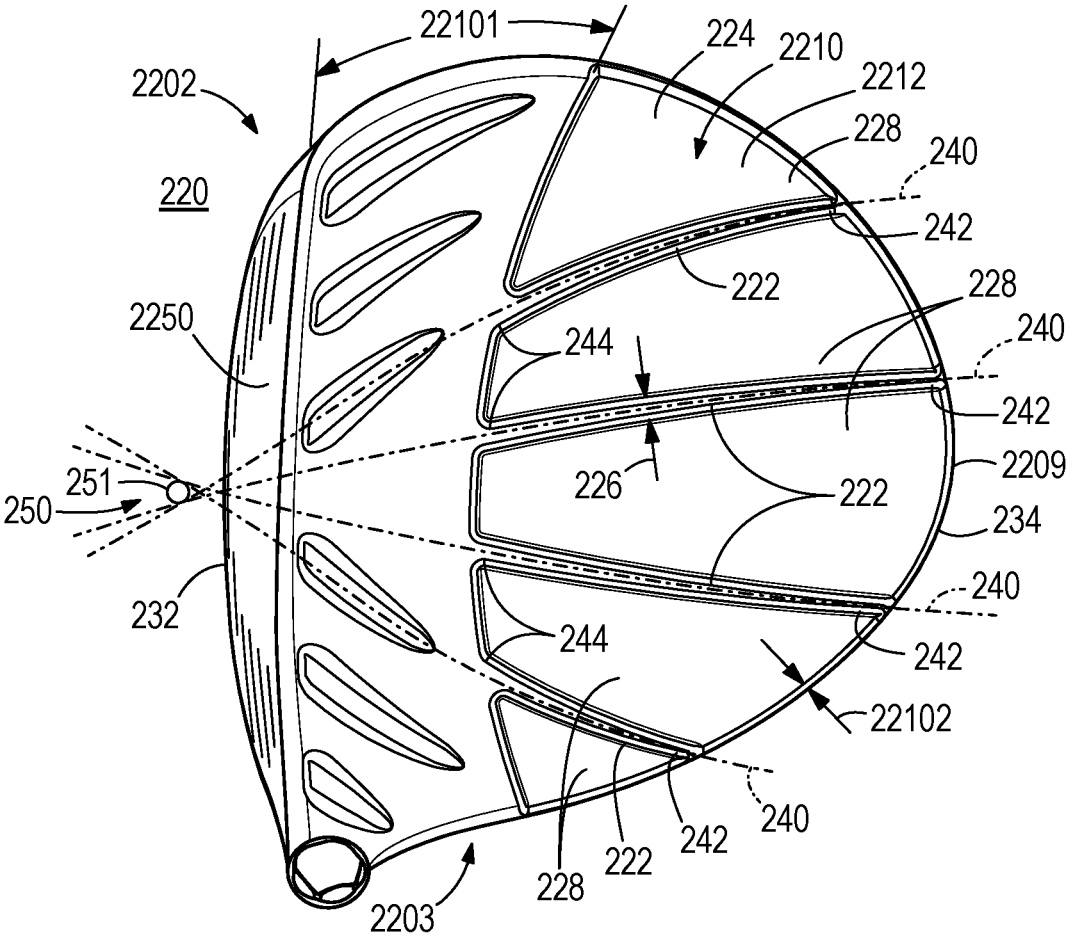
FIG. 20 illustrates a top view of another example of the golf club head comprising ribbed regions.

The ribbed region 2210 can comprise a plurality of one or more external ribs 222 such as more than 1 rib, more than 2 ribs, more than 3 ribs, more than 4 ribs, more than 5 ribs, more than 6 ribs, more than 7 ribs, more than 8 ribs, more than 9 ribs, more than 10 ribs, or any other number of external ribs 222. The one or more external ribs 222 can be substantially perpendicular to the faceplate 2250 or the one or more external ribs 222 can be at an angle to the faceplate 2250. The one or more external ribs 222 comprise first external rib endpoints 242 and second external rib endpoints 244 opposite the first external rib endpoints 242. The one or more external ribs 222 can intersect or do not intersect one another. Further, the one or more external rib axes 240 intersect the first external rib endpoints 242 and the second external rib endpoints 244. In some examples, the external rib axes 240 intersect to a common point 241 within the golf club head 220 or external to the golf club head 220, forward the faceplate 2250. In other examples, with respect to a top view of the golf club head 220, the external rib axes 240 intersect each other and are tangent to a locus 250 defined by a conic section perimeter 251, as illustrated in FIG. 20. In other examples, with respects to a top view of the golf club head 220, a portion of the external rib axes 240 can intersect and are tangent to the locus 250 defined by the conic section perimeter 251.

The one or more external ribs 222 further comprise a rib exterior height similar to rib exterior height 26121, 28121 and 32121, and an external rib width 226. The rib exterior height may range from 0.075 mm to 0.400 mm, 0.075 mm to 0.125 mm, 0.125 to 0.175 mm, 0.250 mm to 0.325 mm, or 0.325 mm to 0.400 mm. For example, the rib exterior height can be 0.075 mm, 0.175 mm, 0.225 mm, 0.350 mm, or 0.400 mm. Each of the rib exterior heights can be equal to each of the other rib exterior heights. In other examples, the rib exterior heights can be different from the other rib exterior heights. The rib exterior heights can stay constant extending from the first external rib endpoint 242 toward the second external rib endpoint 244. In other examples, the rib exterior heights can vary by increasing, decreasing or any combination thereof extending from the first external rib endpoint 242 toward the second external rib endpoint 244. The one or more external ribs 222 define one or more external thin portions 228 positioned between the external ribs 222 of the golf club head 220.

The external rib width 226 may range from 1.25 mm to 6.35 mm, 1.25 mm to 2.35 mm, 2.35 mm to 3.35 mm, 3.35 mm to 4.35 mm, 4.35 mm to 5.35 mm, or 5.35 mm to 6.35 mm. For example, the external rib width 226 can be 1.25 mm, 1.75 mm, 2.50 mm, 3.25 mm, 4.00 mm, 4.75 mm, 5.25 mm, or 6.35 mm. Each of external ribs widths 226 can be equal to each of the other external rib widths 226. In other examples, the external rib widths 226 can be different from the other external rib widths 226. The external rib widths can stay constant extending from the first external rib endpoint 242 toward the second external rib endpoint 244. In other examples, the external rib widths 226 can vary by increasing, decreasing or any combination thereof extending from the first external rib endpoint 242 toward the second external rib endpoint 244.

The one or more external ribs 222 may have any shape including straight, curved, or any other shape. In examples wherein the one or more external ribs 222 are curved, the one or more external ribs 222 may be curved in the same or in different directions. The one or more external ribs 222 may have the same or different radii of curvature. The radii of curvature of the one or more external ribs 222 may progressively increase when moving from near the front end 232 toward near the back end 234, or the radii of curvature of the external ribs 222 may progressively decrease when moving from near the front end 232 toward near the back end 234 of the golf club head 220. The one or more external ribs 222 may be concave or convex relative to faceplate 2250 of the golf club head 220. The external ribs 222 may further be concave or convex relative to the sole 2304 of the golf club head 220. The one or more external ribs 222 may be arranged in any pattern similar to the patterns discussed at least in paragraph [0029] for ribs 2211, 2321, and 2331 (e.g. triangular, rectangular, pentagonal, hexagonal, etc.).

The one or more internal ribs 223 of ribbed region 2210 can comprise a plurality of internal ribs, such as more than 1 rib, more than 2 ribs, more than 3 ribs, more than 4 ribs, more than 5 ribs, more than 6 ribs, more than 7 ribs, more than 8 ribs, more than 9 ribs, more than 10 ribs, or any other number of internal ribs 223. The one or more internal ribs 223 can be substantially perpendicular to the faceplate 2250, substantially parallel to the face pate 2250, or may be at an angle to the faceplate 2250. The one or more internal ribs 223 comprise first internal rib endpoints 243 and second internal rib endpoints 245 opposite the first internal rib endpoints 243. The internal rib axes 246 intersect the first internal rib endpoints 243 and the second internal rib endpoints 245. In some embodiments, the one or more internal ribs 223 can extend from near the back end 234 toward near the front end 232. Further, the one or more internal ribs 223 extending near the back end 234 toward near the front end 232 can intersect or not intersect one another. In other embodiments, the one or more internal ribs 223 can extend from near the heel portion 2203 toward near the toe portion 2202. Further, the one or more internal ribs 223 extending from near the heel portion 2203 toward near the toe portion 2202 can intersect or not intersect each other. In some embodiments, the one or more internal ribs 223 can be aligned with the one or more external ribs 222 when the golf club head is viewed from a top view. The internal rib axes 246 and the external rib axes 240 are also aligned when the golf club head 220 is viewed from a top view.

There can be at least a portion of the one or more internal ribs 223 extending from near the back end 234 toward near the front end 232 (e.g., 1 rib, 2 ribs, 3 ribs, 4 ribs, 5 ribs, 6 ribs, 7 ribs, 8 ribs, 9 ribs, or 10 ribs). Similarly, there can be a portion of the one or more internal ribs 223 extending from near the heel portion 2203 toward near the toe portion 2202 (e.g., 1 rib, 2 ribs, 3 ribs, 4 ribs, 5 ribs, 6 ribs, 7 ribs, 8 ribs, 9 ribs, or 10 ribs). In some embodiments, there can be any combination of a portion of the one or more internal ribs 223 extending from near the heel portion 2203 toward near the toe portion 2202 intersecting with the remaining internal ribs extending from the back end 234 toward near the front end 232. For example, the ribbed region 2210 comprises six internal ribs 223 extending from near the back end 234 toward near the front end 232 intersecting with two internal ribs 223 extending from near the heel portion 2203 toward near the toe end 2202.

The one or more internal ribs 223 comprise an internal rib height and an internal rib width 227. The internal rib height can range from 0.025 mm to 0.250 mm, 0.025 mm to 0.050 mm, 0.050 mm to 0.100 mm, 0.100 mm to 0.150 mm, 0.150 mm to 0.200 mm, or 0.200 mm to 0.250 mm. For example, the internal rib height can be 0.025 mm, 0.060 mm, 0.090 mm, 0.120 mm, 0.140 mm, 0.180 mm, 0.210 mm or 0.225 mm. Each of internal ribs height can be equal to each of the other internal rib heights. In other examples, the internal rib heights can be different from the other internal rib heights. The internal rib heights can stay constant extending from the first internal rib endpoint 243 toward the second internal rib endpoint 245. In other examples, the internal rib heights can vary by increasing, decreasing, or any combination thereof extending from the first internal rib endpoint 243 toward the second internal rib endpoint 245. The one or more internal ribs 223 define one or more internal thin portions 229 disposed between the internal ribs 223 of the golf club head 220.

The internal rib width 227 can range from 1.25 mm to 6.35 mm, 1.25 mm to 2.35 mm, 2.35 mm to 3.35 mm, 3.35 mm to 4.35 mm, 4.35 mm to 5.35 mm, or 5.35 mm to 6.35 mm. For example, the internal rib width 227 can be 1.25 mm, 1.75 mm, 2.50 mm, 3.25 mm, 4.00 mm, 4.75 mm, 5.25 mm, or 6.35 mm. Each of internal ribs width 227 can be equal to each of the other internal rib widths 227. In other examples, the internal rib widths 227 can be different from the other internal rib widths 227. The internal rib widths 227 can stay constant extending from the first internal rib endpoint 243 toward the second internal rib endpoint 245. In other examples, the internal rib widths 227 can vary by increasing, decreasing, or any combination thereof extending from the first internal rib endpoint 243 toward the second internal rib endpoint 245.

The one or more internal ribs 223 may have the same shape and/or configuration as the one or more external ribs 222, or the one or more internal ribs 223 may have a different shape and/or configuration than the one or more external ribs 222. The one or more internal ribs 223 may have any shape including curved, straight, or any other shape. In examples wherein the one or more internal ribs 223 are curved, the one or more internal ribs 223 may be curved in the same or in different directions. Further, the one or more internal ribs 223 may have the same or different radii of curvature. The radii of curvature of the one or more internal ribs 223 extending from near the back end 234 toward near the front end 232 may progressively decrease and/or increase when moving from near the front end 232 toward near the back end 234 of the golf club head 220. The radii of curvature of the internal ribs 223 extending from near the heel portion 2203 toward near the toe portion 2202 may progressively decrease and/or increase when moving from near the heel portion 2203 toward near the toe portion 2202 of the golf club head 220. Further, the radii of curvature of one internal rib 223 to the consecutive internal rib 223 can progressively increase, decrease, or stay constant. The internal ribs 223 may be concave or convex relative to faceplate 2250 of the golf club head 220. The internal ribs 223 may further be concave or convex relative to the sole 2304 of the golf club head 220. The internal ribs 223 may be arranged in any pattern similar to the patterns discussed at least in paragraph [0029] for ribs 2211, 2321, and 2331 (e.g. triangular, rectangular, pentagonal, hexagonal, etc.).

The one or more external thin portions 228, and one or more internal thin portions 229 increase discretionary weight of the golf club head 220, wherein the added discretionary weight can be positioned within the weight structure, or an inner or outer club head edge 2209 of golf club head 220 to enhance performance characteristics.

The one or more external thin portions 228 of ribbed region 2210 may include any number of external thin portions such as 1 external thin portion, 2 external thin portions, 3 external thin portions, 4 external thin portions, 5 external thin portions, 6 external thin portions, 7 external thin portions, 8 external thin portions, 9 external thin portions, 10 external thin portions, or any other number of external thin portions. Similarly, the one or more internal thin portions 229 of ribbed region 2210 may include any number of internal thin portions such as 1 internal thin portion, 2 internal thin portions, 3 internal thin portions, 4 internal thin portions, 5 internal thin portions, 6 internal thin portions, 7 internal thin portions, 8 internal thin portions, 9 internal thin portions, 10 internal thin portions, or any other number of internal thin portions.

One or more external thin portions 228 can be positioned on the ribbed wall exterior surface 224 of the ribbed region 2210 such that greater than 51% of the ribbed wall exterior surface 224 of the ribbed region 2210 comprises external thin portions 228. In other examples, one or more external thin portions 228 can be positioned on the ribbed wall exterior surface 224 of the ribbed region 2210 such that greater than 20%, greater than 25%, greater than 30%, greater than 35%, greater than 40%, greater than 45%, greater than 50%, greater than 55%, greater than 60%, greater than 65%, greater than 70%, greater than 75%, greater than 80%, or greater than 85% of the ribbed wall exterior surface 224 of the ribbed region 2210 comprises one or more external thin portions 228. For example, 40% to 50%, 50% to 60%, 60% to 70%, or 70% to 85% of the ribbed wall exterior surface 224 of the ribbed region 2210 can comprise external thin portions 228. In other examples, 35% to 65%, 30% to 70%, 50% to 70%, or 25% to 75% of the ribbed wall exterior surface 224 of the ribbed region 2210 can comprise external thin portions 228.

One or more internal thin portions 229 can be positioned on the ribbed wall interior surface 225 of the ribbed region 2210 such that greater than 20%, greater than 25%, greater than 30%, greater than 35%, greater than 40%, greater than 45%, greater than 50%, greater than 55%, greater than 60%, greater than 65%, greater than 70%, greater than 75%, greater than 80%, or greater than 85% of the ribbed wall interior surface 225 of the ribbed region 2210 comprises one or more internal thin portions 229. In some examples, 35% to 65%, 40% to 60%, 30% to 70%, or 25% to 75% of the ribbed wall interior surface 225 of the crown 2201 can comprise internal thin portions 229. In some embodiments, one or more external thin portions 228 positioned on the ribbed wall exterior surface 224 of the ribbed region 2210 and one or more internal thin portions 229 positioned on the ribbed wall interior surface 225 of the ribbed region 22101 can aligned when the golf club head 220 is viewed from a top view.

The one or more external thin portions 228 comprise a thickness. In embodiments with the ribbed region 2210 comprising only one or more external ribs 222, the thickness is measure from the ribbed wall interior surface 225 to the ribbed wall exterior surface 224. In embodiments with the ribbed region 2210 comprising both the one or more external ribs 222 and one or more internal ribs 223, the thickness is measured from the interior surface 225/top of the one or more internal ribs 223 to the ribbed wall exterior surface 224. In many examples, the thickness of the one or more external thin portions 228 is less than 0.55 mm. In other examples, the one or more external thin portions 228 can comprise a thickness less than 1.15 mm, less than 1.00 mm, less than 0.80 mm, less than 0.60 mm, less than 0.40 mm, or less than 0.20 mm. For example, the external thin portions 228 can comprise a thickness between 0.20 mm to 0.40 mm, 0.40 mm to 0.60 mm, 0.45 mm to 0.70 mm, 0.60 mm to 0.80 mm, or 0.80 mm to 1.15 mm. In some examples, the thickness of the one or more external thin portions 228 is 0.43 mm.

Similarly, the one or more internal thin portions 229 comprise a thickness. In embodiments with the ribbed region comprising 2210 only one or more internal ribs 223, the thickness is measured from the ribbed wall exterior surface 224 to the ribbed wall interior surface 225. In embodiments with the ribbed region 2210 comprising both the one or more external ribs 222 and one or more internal ribs 223, the thickness is measured from the exterior surface 224/top of the one or more external ribs 222 to the ribbed wall interior surface 225. In many examples, the thickness of the one or more internal thin portions 229 is less than 0.55 mm. In other examples, the one or more internal thin portions 229 can comprise a thickness less than 1.15 mm, less than 1.00 mm, less than 0.80 mm, less than 0.60 mm, less than 0.40 mm, or less than 0.20 mm. For example, the internal thin portions 229 can comprise a thickness between 0.20 mm to 0.40 mm, 0.40 mm to 0.60 mm, 0.45 mm to 0.70 mm, 0.60 mm to 0.80 mm, or 0.80 mm to 1.15 mm. In some examples, the thickness of the one or more internal thin portions 229 is 0.43 mm.

The golf club head 220 having one or more external thin portions 228 and/or internal thin portions 229 can be manufacturing using centrifugal casting. In other examples, portions of golf club head 220 having one or more external thin portions 228 and/or internal thin portions 229 can be manufactured using other suitable methods, such as stamping, forging, or machining. In examples where portions of the golf club head 220 having one or more external thin portions and/or internal thin portions 229 are manufactured using stamping, forging, or machining, the portions of the golf club head 220 can be coupled using epoxy, tape, welding, mechanical fasteners, or other suitable methods.

In one embodiment, the ribbed region 2210 comprises a first external rib 222, and a second external rib 222. The first external rib 222 comprises a first first external rib endpoint 242, a second first external rib endpoint 244, and a first external rib axis 240 extending through the first first external rib endpoint 242 and the second first external rib endpoints 244. Similarly, the second external rib 222 comprises a first second external rib endpoint 242, a second second external rib endpoint 244, and a second external rib axis 240 extending through the first second external rib endpoint 242 and the second second external rib endpoints 244. The first and second external rib axes 240 intersect to a common point 241 external to the golf club head 220, forward the faceplate 2250.

Figure 17:
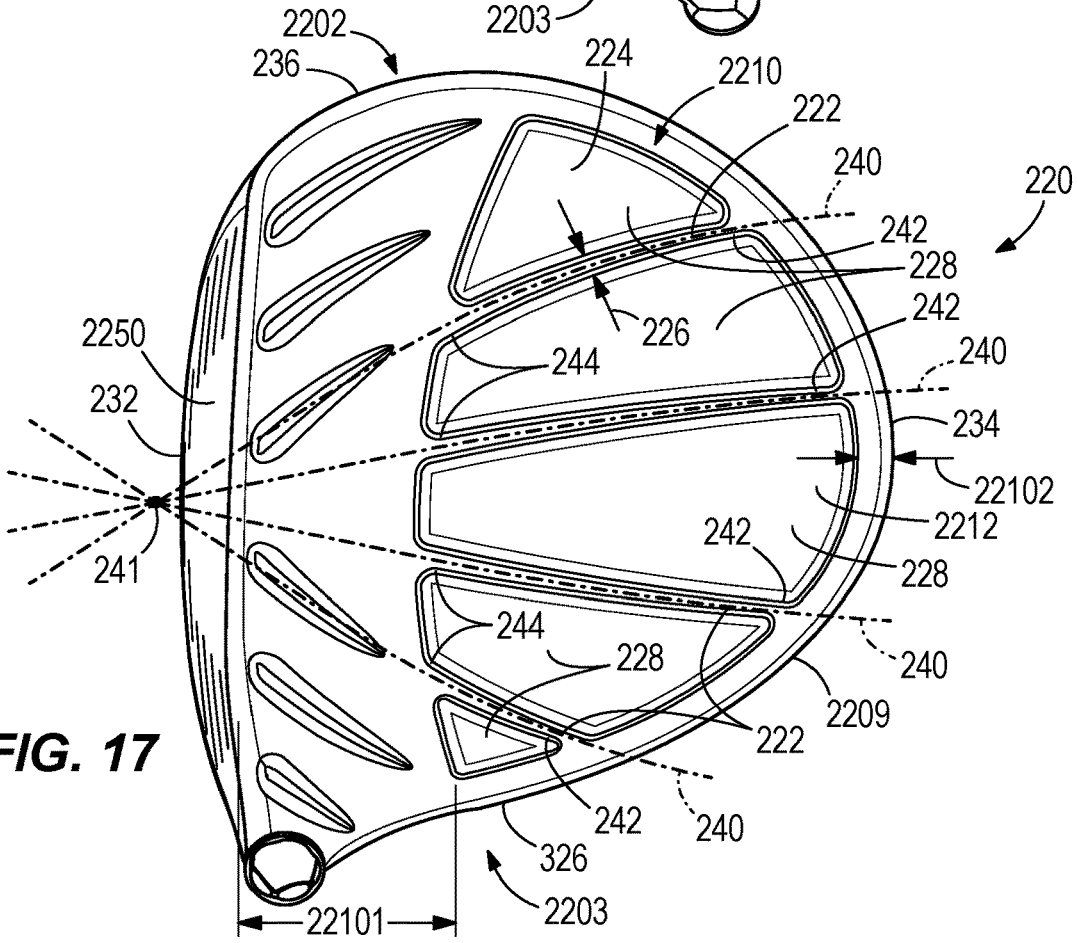
FIG. 17 illustrates a top view of an exemplary golf club head comprising ribbed regions.

As illustrated in FIG. 17, ribbed region 2210 comprises four external ribs 222. The four external ribs 222 define rib axes 240 that intersect to a common point 241 external to the golf club head 220, forward the faceplate 2250. The four external ribs 222 further define five external thin portions 228, wherein the thickness of the five external thin portions 228 are 0.43 mm. Further, the four external ribs 222 comprise a slight curvature and extend from near the back end 234 toward near the front end 232 of the golf club head 220. The four external ribs 222 do not intersect each other. The rib exterior height is 0.255 mm and the external rib width 226 tapers from 4.06 mm near the front end 232 of the golf club head 220 to 2.03 mm near the back end 234 of the golf club head 220.

In the exemplary embodiment, front distance 22101 measured from the faceplate 2250 to the ribbed region 2210 is varying, while the rear distance 22102 measured from the club head edge 2209 to the ribbed region 2210 is constant. The front distance 22101 is measured to be 25 mm to 40 mm, with the front distance 22101 greatest near the toe portion 2202 and heel portion 2203. The rear distance 22102 is 6.35 mm.

Figure 16:
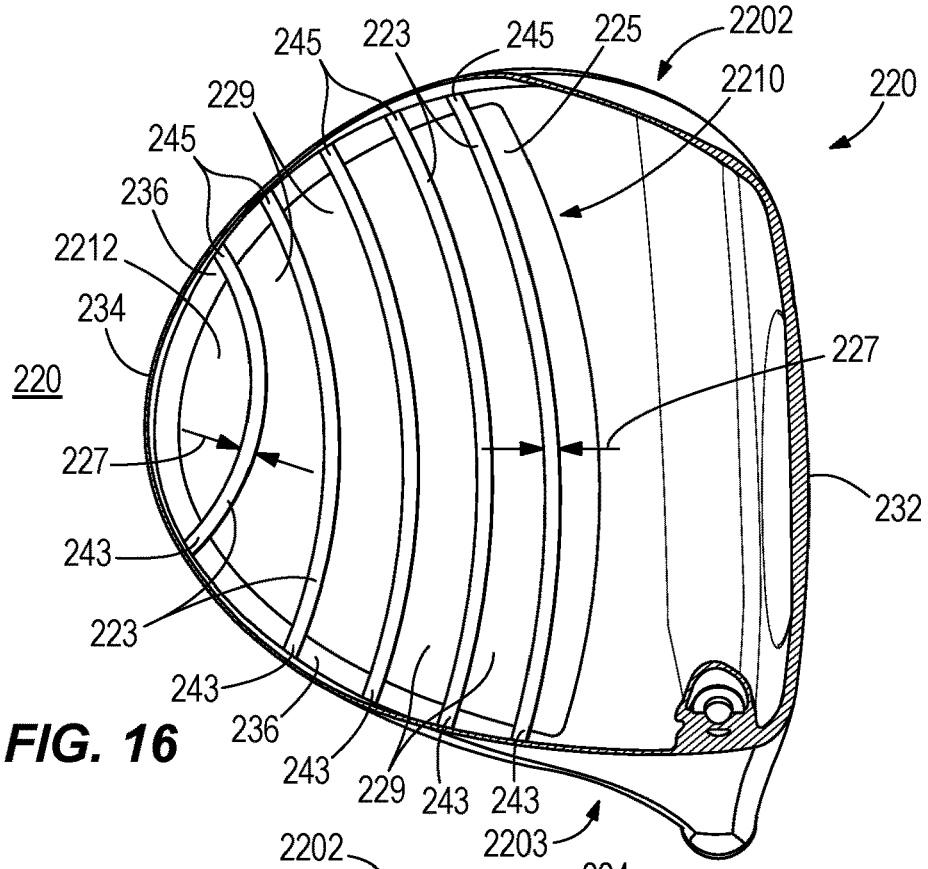
FIG. 16 illustrates a bottom, cross sectional view of an exemplary golf club head comprising ribbed regions.

As illustrated in FIG. 16 are the internal ribs 223 for the exemplary embodiment of FIG. 17. The ribbed region 2210 comprises five internal ribs 223. The five internal ribs 223 extend from near the heel portion 2203 to near the toe portion 2202 of the golf club head 220. Further, the five internal ribs 223 extend beyond the internal thin portions 229 of the ribbed region 2210 and into a perimeter 236 of the golf club head 220. The five internal ribs 223 are curved such the ends of the five internal ribs 223 are positioned closer to the back end 234 of the golf club head 220 than the center of the five internal ribs 223. Further, the five internal ribs 223 are curved in the same direction and the radii of curvature of the five internal ribs 223 progressively decreases when moving from the front end 232 toward the back end 234 of the golf club head 220. The internal rib height is 1.016 mm, and the internal rib width 227 is 4.064 mm.

The one or more internal ribs 223 of FIG. 16 improve the casting rate of golf club head 220 by 4% to 10% compared to a club head devoid of internal ribs that extend beyond internal thin portions and into a perimeter of the club head. The casting rate of a club head is a measurement of casting ability that takes into account defects, such as, for example, non-fill in the crown, metal flow marks, porosity, and slag.

Figure 18:
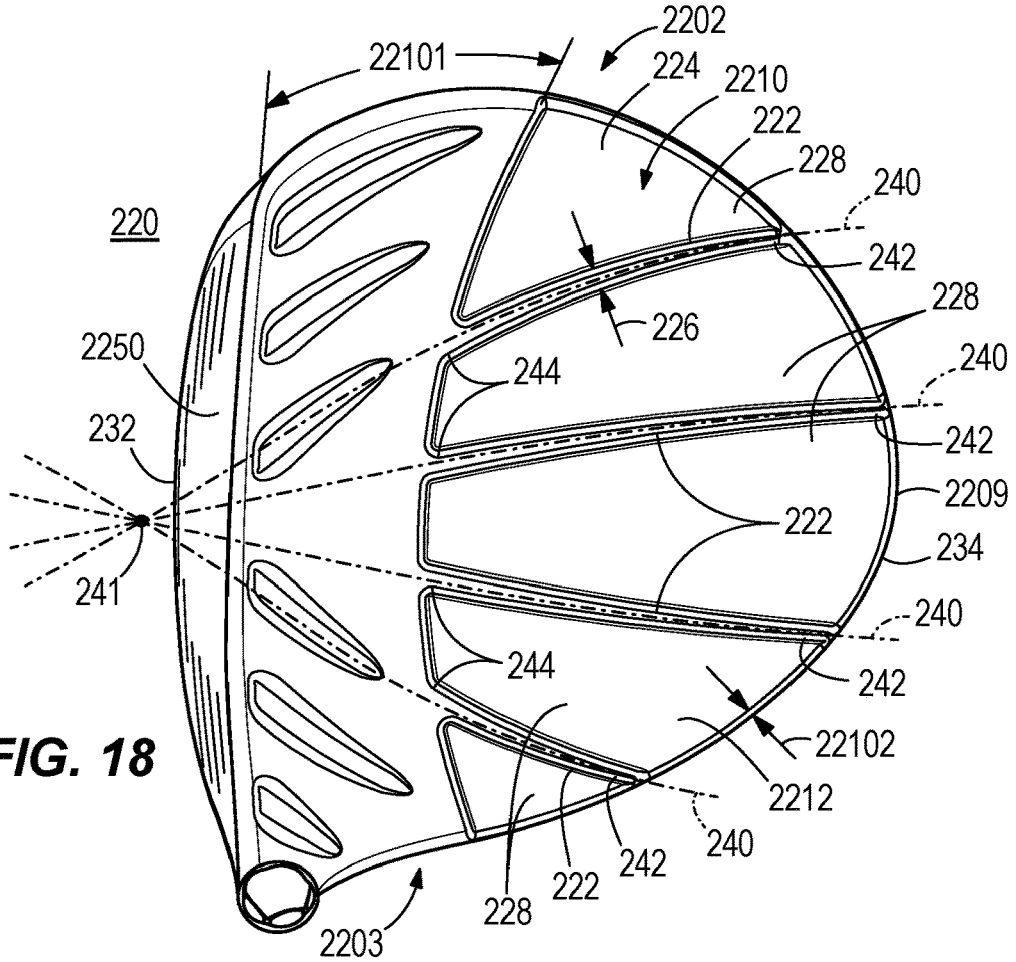
FIG. 18 illustrates a top view of another exemplary golf club head comprising ribbed regions.

Illustrated in FIG. 18, is another embodiment of the one or more external ribs 222 of the ribbed region 2210. The ribbed region 2210 comprises four external ribs 222. The four external ribs 222 define rib axes 240 that intersect to common a point external to the golf club head 220. The four external ribs 222 further define five external thin portions 228, wherein the thickness of the five external thin portions 228 are 0.43 mm to 0.557 mm. Further, the four external ribs 222 comprise a slight curvature and extend from near the back end 234 toward near the front end 232 of the golf club head 220. The four external ribs 222 do not intersect each other. The rib exterior height is 0.510 mm and the external rib width 226 tapers from 3.80 mm near the front end 232 of the golf club head 220 to 1.80 near the back end 234 of the golf club head 220.

In the exemplary embodiment, front distance 22101 measured from the faceplate 2250 to the ribbed region 2210 is varying, while the rear distance 22102 measured from the club head edge 2209 to the ribbed region 2210 is constant. The front distance 22101 is measured to be 25 mm to 40 mm, with the front distance 22101 greatest near the toe portion 2202 and heel portion 2203. The rear distance 22102 is 1 mm.

Figure 19:
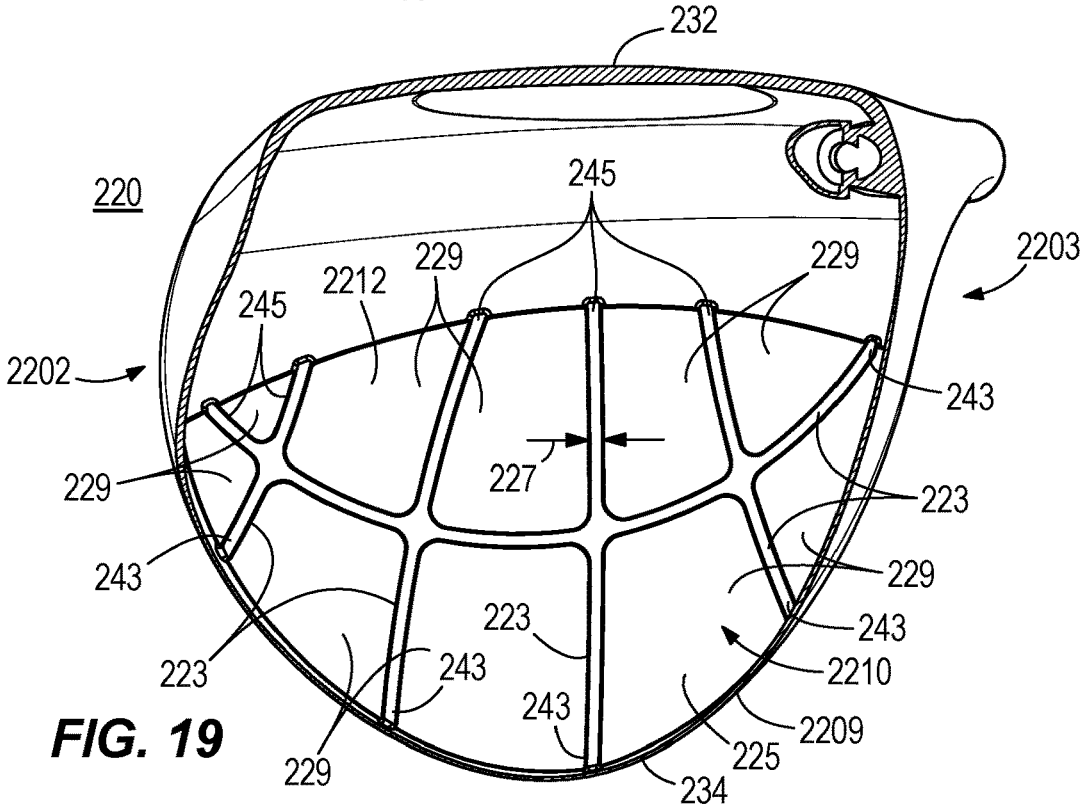
FIG. 19 illustrates a bottom view of the exemplary the golf club head of FIG. 18.

Illustrated in FIG. 19 are the one or more internal ribs 223 for the ribbed region 2210 for exemplary embodiment of FIG. 18. The ribbed region 2210 comprises five internal ribs 223. Four of the five internal ribs 223 have a slight curvature and extend from near the back end 234 toward near the front end 232. The four out of the five internal ribs 223 do not intersect one another and is further aligned with the four external ribs 222 of FIG. 18 when the golf club head 220 is viewed from a top view. The remaining fifth internal rib 223 is concave relative to the faceplate 2250 and extends from near the heel portion 2203 toward near the toe portion 2202. The fifth internal rib 223 intersects the other four internal ribs 223. The internal ribs 223 define ten internal thin portions 229, wherein the ten internal thin portions 229 are aligned with the five external thin regions 228 of FIG. 18 when the golf club head 220 is viewed from a top view. The ten internal thin portions have thicknesses of 0.43 mm. The internal rib height is 0.127 mm, and the internal rib width 227 is approximately 4.60 mm.

The internal ribs 223 of FIG. 19 improves the flow of casting materials within the one or more internal thin portions 229, and the one or more external thin portions 228 by 10% to 15% compared to other internal and external ribs. In another embodiment of the ribbed region 2210 of the golf club head 220, the ribbed region 2210 can comprise the one or more external ribs 222 of FIG. 17 and the one or more internal ribs 223 of FIG. 19, and any variation of characteristics of FIGS. 17 and 19. In other embodiments of the ribbed region 2210 of the golf club head 220, the ribbed region 2210 can comprise the one or more external ribs 222 of FIG. 18 and the one or more internal ribs 223 of FIG. 16, and any variation of characteristics of FIGS. 16 and 18.

In the illustrated embodiments of FIGS. 16-19, ribbed region 2210 of golf club head 220 further includes a crown thickness. The crown thickness may range from approximately 0.127 mm to 0.635 mm, 0.127 mm to 0.175 mm, 0.175 mm to 0.225 mm, 0.225 mm to 0.300 mm, 0.300 mm to 0.350 mm, 0.350 mm to 0.475 mm, 0.475 mm to 0.550 mm, or 0.550 mm to 0.635 mm. For example, the crown thickness can be 0.127 mm, 0.255 mm, 0.315 mm, 0.390 mm, 0.440 mm, 0.0470 mm, 0.525 mm, 0.580 mm, or 0.635 mm.

In another embodiment of the golf club head 220, as illustrated in FIGS. 21-25, the crown 2201 of the club head 220 can comprise a ribbed region 2210. The ribbed region 2210 can comprise a ribbed wall 2212, wherein the ribbed wall 2212 can have one or more raised structures, raised surfaces, or external ribs 222 that protrude from a ribbed wall exterior surface 224. In the illustrated embodiment, the club head 220 can include two curved external ribs 222 extending from near the front end 232 to near the back end 234 of the club head 220.

The golf club head 220 can comprise a front distance 22101 measured from the top of the face plate 2250 to the ribbed region 2210. In many embodiments, the front distance 22101 can be the same from one external rib 222 to an adjacent external rib 222. In some embodiments, the front distance 22101 can be different from one external rib to a adjacent external rib 222. In some embodiments, the front distance 22101 can increase, decrease, or vary in a direction from the toe portion 2202 and/or heel portion 2203 to a center of the crown 2201. In some embodiments, the front distance 22101 can be constant in a direction from the toe portion 2202 to the heel portion 2203.

Figure 21:
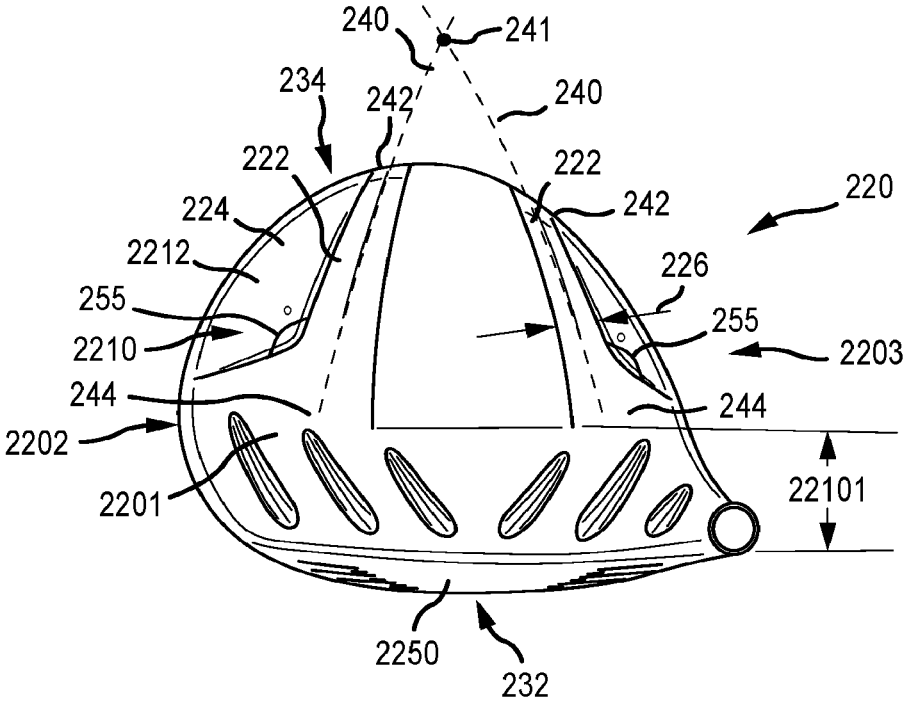
FIG. 21 illustrates a top view of an exemplary golf club head comprising ribbed regions according to another embodiment.
Figure 22:
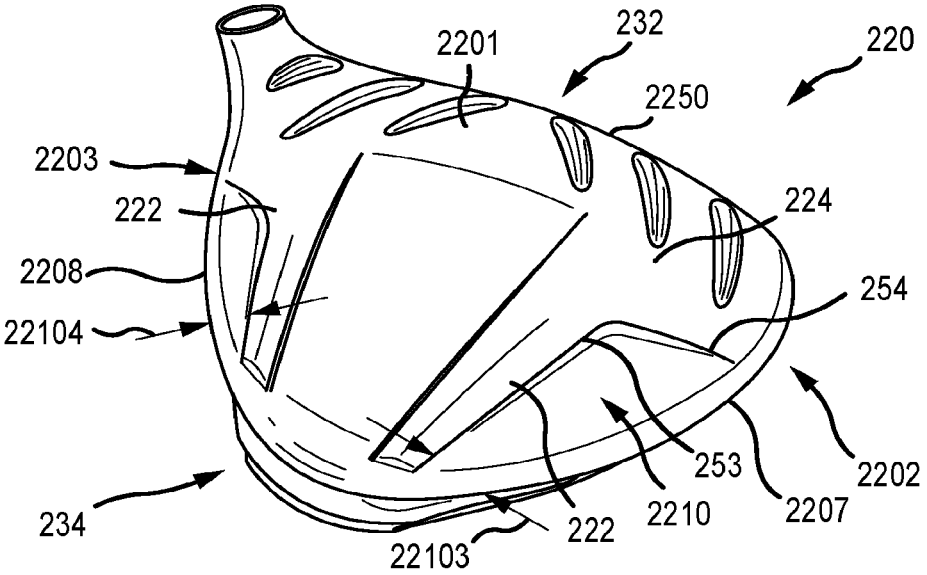
FIG. 22 illustrates a rear perspective view of the golf club head of FIG. 21.

As illustrated in FIG. 22, the golf club head 220 can further comprise a toe club head edge 2207 and a heel club head edge 2208. The toe club head edge 2207 can be defined along a perimeter of the toe portion 2202. The heel club head edge 2208 can be defined along a perimeter of the heel portion 2203. A toe side rear distance 22103 can be measured from the toe club head edge 2207 to the external rib 222. A heel side rear distance 22104 can be measured from the heel club head edge 2208 to the external rib 222. In many embodiments, the toe side rear distance 22103 and/or the heel side rear distance 22104 can vary in a direction from the back end 234 to the front end 232. In some embodiments, the toe side rear distance 22103 and/or the heel side rear distance 22104 can be constant in a direction from the back end 234 to the front end 232. In other embodiments, the toe side rear distance 22103 and/or heel side rear distance 22104 can increase or decrease in a direction from the back end 234 to the front end 232. In many embodiments, the toe side rear distance 22103 and/or the heel side rear distance 22104 can range from 0.1 inch to 2.0 inch. In some embodiments, the toe side rear distance 22103 and/or the heel side rear distance 22104 can range from 0.1 inch to 1.0 inch, or 1.0 inch to 2.0 inches. In some embodiments, the toe side rear distance 22103 and/or the heel side rear distance 22104 can range from 0.1 inch to 0.5 inch, 0.5 inch to 1.0 inch, 1.0 inch to 1.5 inches, or 1.5 inches to 2.0 inches. For example, the toe side rear distance 22103 and/or the heel side rear distance 22104 can be 0.1, 0.2, 0.3, 0.4, 0.5, 0.6, 0.7, 0.8, 0.9, 1.0, 1.1, 1.2, 1.5, or 2.0 inches. As illustrated in FIGS. 21 and 22, the toe side rear distance 22103 and the heel side rear distance 22104 can vary in a direction from the back end 234 to the front end 232.

The external ribs 222 can comprise a length measured in a direction generally extending from near the front end 232 to near the back end 234 of the club head 220. In many embodiments, the length of the external ribs 222 can comprise at least 50% of the length of the club head 220 from the front end 232 to the back end 234. In some embodiments, the length of the external ribs 222 can comprise at least 20%, 25%, 30%, 35%, 40%, 45%, 50%, 55%, 60%, 65%, 70%, or 75% of the length of the club head 220 from the front end 232 to the back end 234. Further, in many embodiments, the external ribs 222 can be positioned on the back 50% of the length of the club head 220 from the front end 232 to the back end 234. In some embodiments, the external ribs 222 can be positioned on the back 10%, 20%, 30%, or 40% of the length of the club head 220 from the front end 232 to the back end 234. In other embodiments, the length of the external ribs 222 can comprise 10% to 80% of the length of the club head 220. In some embodiments, the length of the external ribs 222 can comprise 10% to 40%, or 40% to 80% of the length of the club head 220. In some embodiments, the length of the external ribs 222 can comprise 10% to 40%, 20% to 50%, 30% to 60%, 40% to 70%, or 50% to 80% of the length of the club head 220. In other embodiments, the external ribs 222 can be positioned anywhere on the crown 2201 of the club head 220. For example, in other embodiments, the external ribs 222 can extend along any portion of the crown 2201 of the club head 220 from the front end 232 to the back end 234 of the club head 220.

The external ribs 222 further comprise a width 226. The width 226 of the external ribs 222 can be measured in a direction extending generally from near the heel portion 2203 to near the toe portion 2202. In many embodiments, the width 226 of the external ribs 222 can be greater near the front end 232 than near the back end 234. In other embodiments, the width 226 of the external ribs 222 can be greater near the back end 234 than near the front end 232. In many embodiments, the width 226 of the external ribs 222 can increase from near the back end 234 to near the front end 232 of the club head 220. In some embodiments, the width 226 of the external ribs can decrease from near the back end 234 to near the front end 232 of the club head 220. In other embodiments, the width 226 of the external ribs 222 can remain constant, or the width 226 of the external ribs 222 can vary according to any profile along the length of the external ribs 222. In many embodiments, the width 226 at any point along the length of the external ribs 222 can range from 2.54 mm (0.1 inch) to 38.1 mm (1.5 inches). In some embodiments, the width 226 at any point along the length of the external ribs 222 can range from 2.54 mm (0.1 inch) to 25.4 mm (1.0 inch), or 25.4 mm (1.0 inch) to 38.1 mm (1.5 inches). In some embodiments, the width 226 at any point along the length of the external ribs 222 can range from 2.54 mm (0.1 inch) to 12.7 mm (0.5 inch), 5.08 mm (0.2 inch) to 20.32 mm (0.8 inch), 5.08 mm (0.2 inch) to 25.4 (1.0 inch), 7.62 mm (0.3 inch) to 22.86 mm (0.9 inch), 12.7 mm (0.5 inch) to 25.4 mm (1.0 inch), or 25.4 mm (1.0 inch) to 38.1 mm (1.5 inches). For example, the width 226 at any point along the length of the external ribs 222 can be 2.54 mm (0.1 inch), 7.62 mm (0.3 inch), 15.24 mm (0.6 inch), 22.86 mm (0.9 inch), 30.48 mm (1.2 inch), or 38.1 mm (1.5 inches).

The external ribs 222 further comprise a height. The height of the external ribs 222 can be measured as the distance the external ribs 222 protrude from the ribbed wall exterior surface 224 of the crown 2201. In many embodiments, the height of the external ribs 222 can decrease from near the back end 234 to near the front end 232 of the club head 220. In some embodiments, the height of the external ribs 222 can increase from near the back end 234 to near the front end 232. Further, the height of the external ribs 222 can remain constant or can vary according to any profile along the length or width of the external ribs 222.

As illustrated in FIGS. 21 and 22, the external ribs 222 can comprise an angle 255 defined as an angle between a longitudinal edge 253 and a lateral edge 254 of the external ribs 222. The longitudinal edge 253 extends in a direction generally from the back end 234 to the front end 232. The lateral edge 254 extends in a direction generally from the toe portion 2202 to the heel portion 2203 or from the heel portion 2203 to the toe portion 2202. In many embodiments, the angle 255 can be an obtuse angle. In other embodiments, the angle 255 can be an acute angle (i.e. 0 to 90 degrees), a right angle (i.e. 90 degrees), or a straight angle (i.e. 180 degrees). In many embodiments, the angle 255 can range from 0 to 180 degrees. In some embodiments, the angle 255 can range from 0 to 90 degrees, or 90 to 180 degrees. In some embodiments, the angle 255 can range from 0 to 45 degrees, 45 to 90 degrees, 90 to 135 degrees, or 135 to 180 degrees. In other embodiments, the angle 255 can range from 90 to 140 degrees, 95 to 145 degrees, 100 to 150 degrees, 105 to 155 degrees, or 110 to 160 degrees. For example, the angle 255 can be 0, 45, 90, 95, 100, 105, 110, 115, 120, 125, 130, 135, 140, 145, 150, 155, 160, 165, 170, 175, or 180 degrees. The illustrated angles 255 of FIGS. 21-25 are generally between 95 to 145 degrees.

The external ribs 222 can be positioned at an angle to the faceplate 2250, such that the external ribs 222 converge near the back end 234 of the club head 220. In many embodiments, the external ribs 222 do not intersect each other within the golf club head 220. In other embodiments, the external ribs 222 can intersect each other within the golf club head 220. The external ribs 222 can include a first external rib 222 positioned offset from the geometric center of the faceplate 2250 toward the toe portion 2202, and a second external rib 222 positioned offset from the geometric center of the faceplate 2250 toward the heel portion 2203. The first external rib 222 can comprise a first, first external rib endpoint 242, a second, first external rib endpoint 244, and a first external rib axis 240 extending through the first, first external rib endpoint 242 and the second, first external rib endpoint 244. Similarly, the second external rib 222 can comprise a first, second external rib endpoint 242, a second, second external rib endpoint 244, and a second external rib axis 240 extending through the first, second external rib endpoint 242 and the second, second external rib endpoint 244. In many embodiments, the first and second external rib axes 240 can intersect within the golf club head 220 or external to the golf club head 220, rearward of the face plate 2250. In some embodiments, as illustrated in FIG. 21, the first and second external rib axes 240 can intersect at a common point 241 within the golf club head 220 or external to the golf club head 220, rearward of the faceplate 2250.

Figure 24:
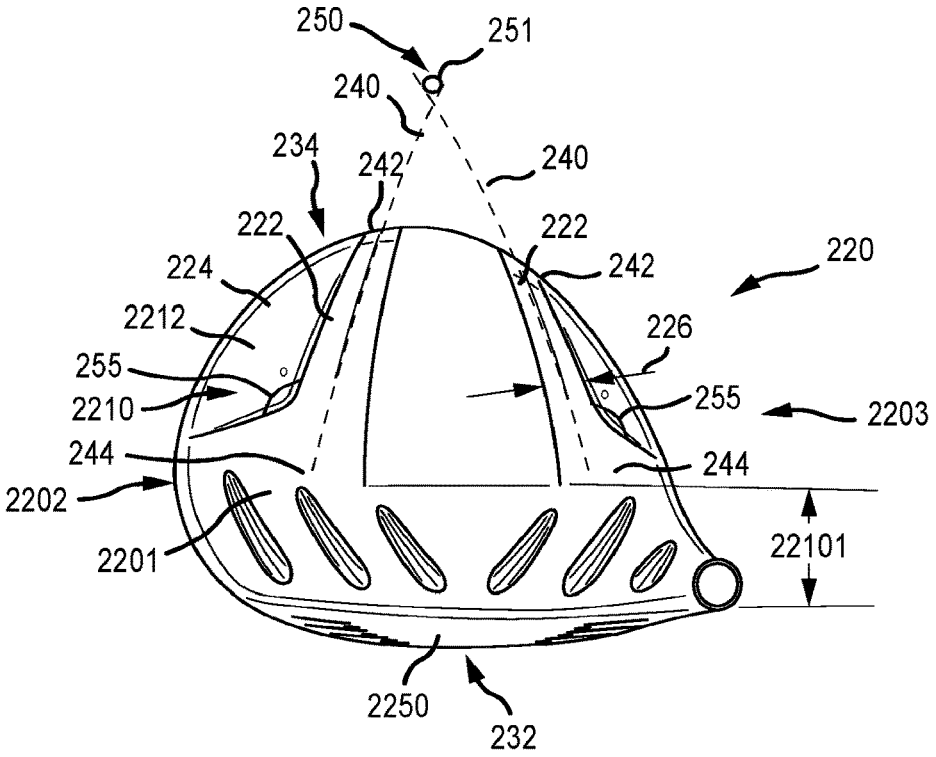
FIG. 24 illustrates a top view of another example of the golf club head comprising ribbed regions.
Figure 25:
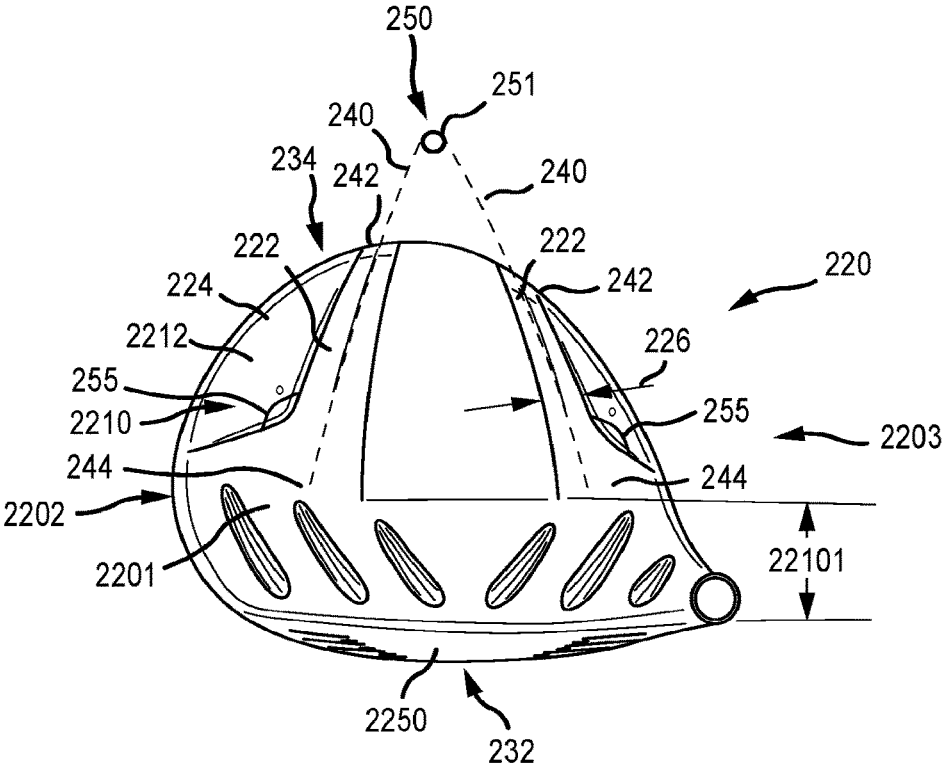
FIG. 25 illustrates a top view of another example of the golf club head comprising ribbed regions.

In other embodiments, as illustrated in FIG. 24, with respect to a top view of the golf club head 220, the external rib axes 240 intersect each other and are tangent to a locus 250 defined by a conic section perimeter 251 external to the golf club head 220, rearward of the faceplate 2250. In other embodiments, as illustrated in FIG. 25, the external rib axes 240 do not intersect each other and are tangent to a locus 250 defined by a conic section perimeter 251 external to the golf club head 220, rearward of the faceplate 2250. The conic section perimeter can extend in a direction orthogonal to a ground plane when the golf club head 220 is at an address position, and the locus 250 can comprise an area or a volume bounded by the conic section perimeter 251. Conic section perimeter 251 can comprise a circular perimeter. In other embodiments, the conic section perimeter 251 can comprise a semi-circular perimeter, an elliptical perimeter, a semi-elliptical perimeter, a parabolic perimeter, or a hyperbolic perimeter.

In many embodiments, a distance between the external ribs 222, measured in a generally heel portion 2203 to toe portion 2202 direction, can decrease from near the front end 232 to near the back end 234 of the club head 220. In some embodiments, the distance between the external ribs 222 can increase from near the front end 232 to near the back end 234 of the club head 220. The first and second external ribs 222 can be symmetric about a plane extending through the geometric center of the faceplate 2250 from the front end 232 to the back end 234 of the club head 220. In other embodiments, the first and second external ribs 22 can be asymmetric about the plane extending through the geometric center of the face plate 2250 from the front end 232 to the back end 234 of the club head 220.

Accordingly, the external ribs 222 can assist a golfer in aligning a golf ball with the center of the faceplate 2250 at the address position and during impact. The angle of the external ribs 222 to the faceplate 2250 further provides a converging runway visual aid allowing the golfer to easily align the golf ball with the center of the faceplate 2250 during the address position and during impact. Further, in many embodiments, the external ribs 222 on the crown 2201 of the golf club head 220 provide structural reinforcement to the crown 2201 during impact with a golf ball. The angle of the external ribs 222 to the faceplate 2250 further provides structural reinforcement to the crown 2201 by allowing the larger thickness of the external ribs 222 to converge to the thinnest areas of the crown 2201 generally located at a center of the crown 2201. More specifically, the external ribs 222 on the crown 2201 of the club head 220 provides dent resistance from the resonant forces during golf ball impacts. The external ribs 222 provide a greater thickness on the crown 2201 in portions where the club head 220 is susceptible to large resonant forces. Increasing the crown 2201 thickness with the external ribs 222 in portions where the large resonant forces occur allows the crown 2201 to be thinned while preventing denting of the crown 2201 during golf ball impacts. Further, in many embodiments, the external ribs 222 on the crown 2201 of the club head 220 provide improved acoustic properties during impact with a golf ball.

The crown 2201 or ribbed wall 2212 of the club head 220 can further include a thickness that is less than the thickness of current hollow body, wood-type club heads. In many embodiments, the thickness of the crown 2201 or ribbed wall 2212 can range between 0.012 to 0.035 inch (0.305 to 0.890 mm). In other embodiments, the thickness of the crown 2201 or ribbed wall 2212 can be less than 0.035 inch (0.890 mm), less than 0.031 inch (0.8 mm), less than 0.03 inch (0.762 mm), less than 0.025 (0.635 mm), less than 0.02 (0.508 mm), or less than 0.015 inch (0.381 mm). The thickness of the crown 2201 can remain constant, or the thickness can vary in different regions of the crown 2201.

In these or other embodiments, the thickness of the crown 2201 can vary from near the front end 232 to near the back end 234, from near the heel portion 2203 to near the toe portion 2202, or in any direction along the crown 2201 of the club head 220. In some embodiments, the thickness of the crown 2201 can decrease from near the front end 232 toward the back end 234 of the club head 220 in sections extending from the heel portion 2203 to the toe portion 2202. For example, the thickness of the crown 2201 in the front ⅓ of the length of the club head 220 from the front end 232 to the rear end 234 can be between 0.025 inch (0.635 mm) and 0.035 inch (0.890 mm), the thickness of the crown 2201 in the central ⅓ of the length of the club head 220 from the front end 232 to the back end 234 can be between 0.020 inch (0.508 mm) and 0.030 inch (0.762 mm), and the thickness of the crown 2201 in the rear ⅓ of the length of the club head 220 from the front end 232 to the back end 234 can be between 0.012 inch (0.305 mm) and 0.025 inch (0.635 mm).

In these embodiments, the thickness of the crown 2201 can decrease gradually, can decrease with one or more steps, or can decrease according to any profile from near the front end 232 toward the back end 234 of the club head 220. In these embodiments, the thickness at a given location of the crown 2201 can correspond to the stress experienced by that location of the crown 2201 during impact. Typically, the stress experienced by the crown 2201 near the front end 232 of the club head 220 is higher than the stress experienced by the crown 2201 near the back end 234 of the club head 220 on impact with a golf ball. Increasing the thickness of the crown 2201 with wider external ribs near the front end 232 of the club head 220 further increases the structural rigidity near the front end 232 thereby reducing stresses in the crown 2201 on impact with the golf ball. Accordingly, the thickness can be low near the back end 234 of the club head 220, to reduce club head weight in regions of the club head 220 where durability is not a concern due to lower impact stress. Accordingly, weight savings or weight repositioning can be achieved by reducing the thickness in regions near the back end 234 of the club head 220 to improve the club head center of gravity position (i.e. low and back) and/or increase club head moment of inertia, without sacrificing club head durability.

Figure 23:
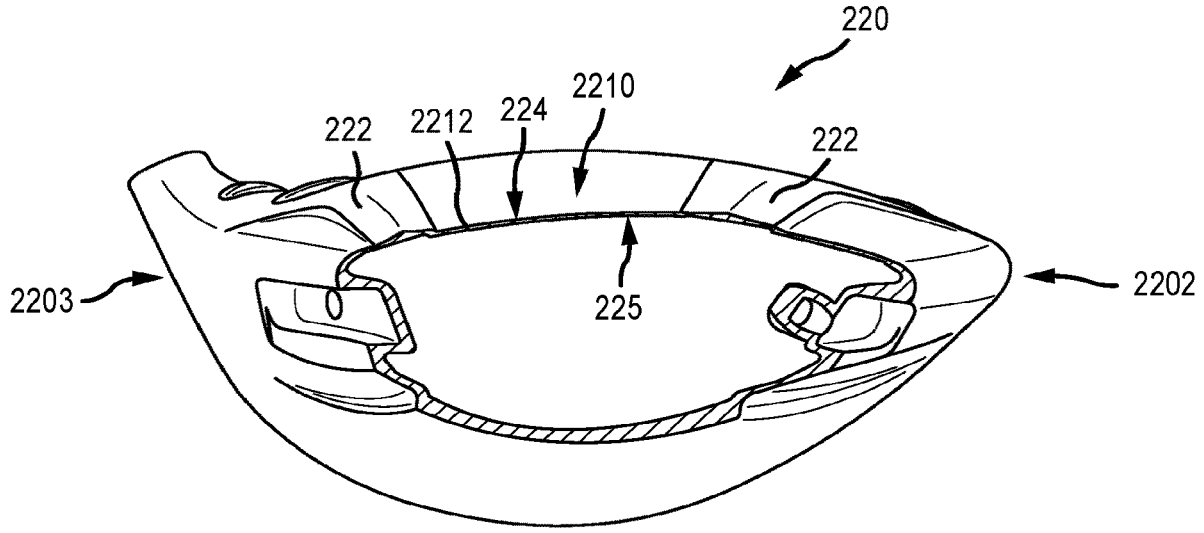
FIG. 23 illustrates a cross-section rear view of the golf club head of FIG. 21.

In some embodiments, the thickness (i.e. distance the ribbed region 2210 protrudes from the crown 2201) of the ribbed region 2210 can vary between portions of the ribbed wall 2212 comprising the external ribs 222 and portions of the ribbed wall 2212 devoid of the external ribs 222. For example, the thickness of the ribbed wall 2212 at the external ribs 222 can be the same as or similar to the thickness of the ribbed wall 2212 adjacent to the external ribs 222. In these embodiments, the internal contour of a ribbed wall interior surface 225 changes in accordance with the ribbed wall exterior surface 224 to maintain a similar thickness of the ribbed wall 2212 along the external ribs 222 as adjacent to the external ribs 222. For further example, the thickness of the ribbed wall 2212 at the external ribs 222 (or at least a portion of the external ribs 222) can be greater than the thickness of the ribbed wall 2212 in regions devoid of the external ribs 222. In these embodiments, the internal contour of the ribbed wall interior surface 225 can remain substantially smooth or constant from a location at the external ribs 222 to a location adjacent the external ribs 222. Further, the thickness of the ribbed wall 2212 can vary along the length or width 226 of the external ribs 222, as illustrated in FIG. 23, where the thickness of the ribbed wall 2212 can be greatest at the center of the width 226 of the external ribs 222.

In another embodiment of the golf club head 220, as illustrated in FIGS. 26-30, the crown 2201 of the club head 220 can comprise a ribbed region 2210. The ribbed region 2210 can comprise a ribbed wall 2212, wherein the ribbed wall 2212 can have one or more raised structures, raised surfaces, or external ribs 222 that protrude from a ribbed wall exterior surface 224. In the illustrated embodiment, the club head 220 can include two external ribs 222 extending from near the front end 232 to near the back end 234 of the club head 220.

The golf club head 220 can comprise a front distance 22101 measured from the top of the face plate 2250 to the ribbed region 2210. In many embodiments, the front distance 22101 can be the same from one external rib 222 to an adjacent external rib 222. In some embodiments, the front distance 22101 can be different from one external rib to an adjacent external rib 222. In some embodiments, the front distance 22101 can increase, decrease, or vary in a direction from the toe portion 2202 and/or heel portion 2203 to a center of the crown 2201. In some embodiments, the front distance 22101 can be constant in a direction from the toe portion 2202 to the heel portion 2203.

Figure 26:
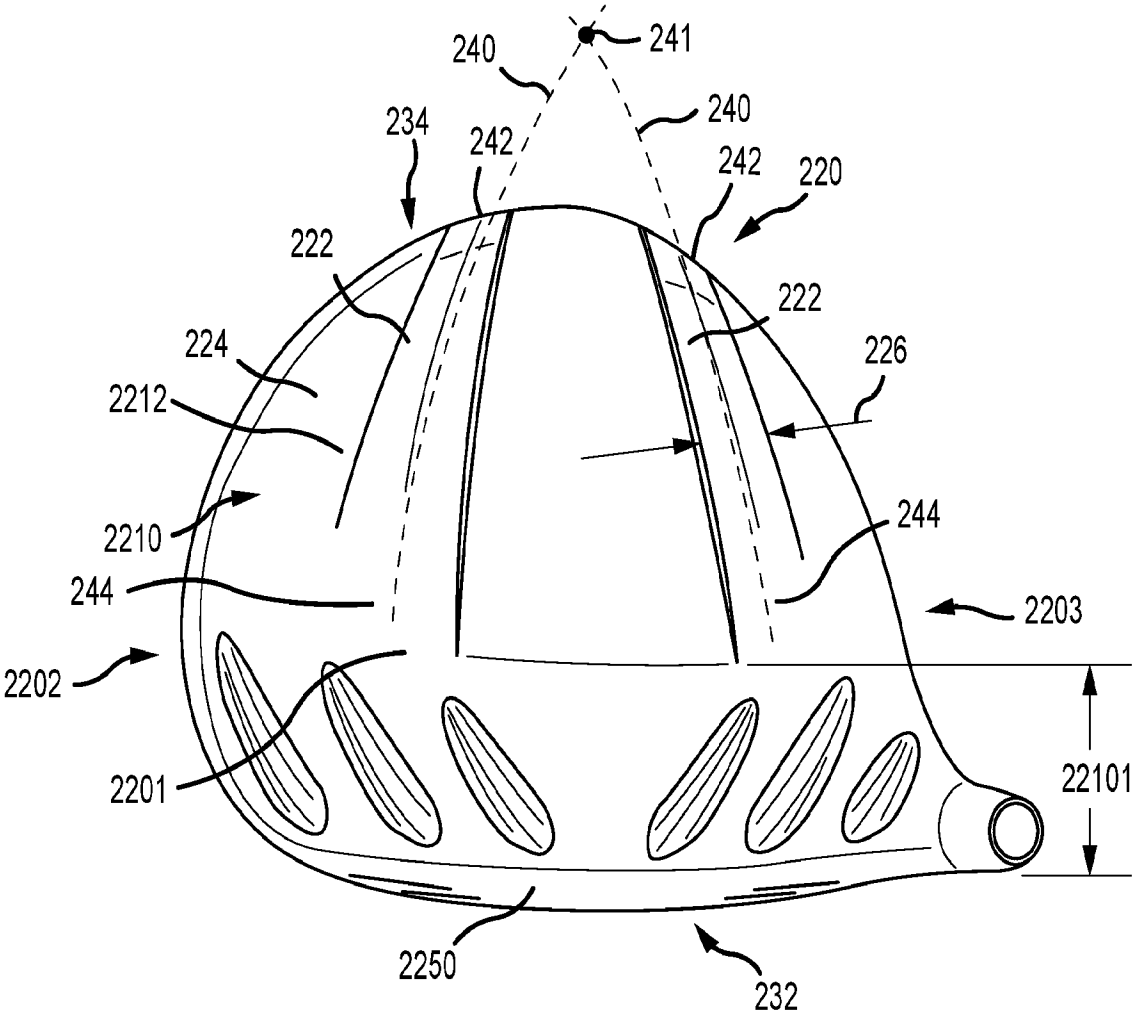
FIG. 26 illustrates a top view of an exemplary golf club head comprising ribbed regions according to another embodiment.
Figure 27:
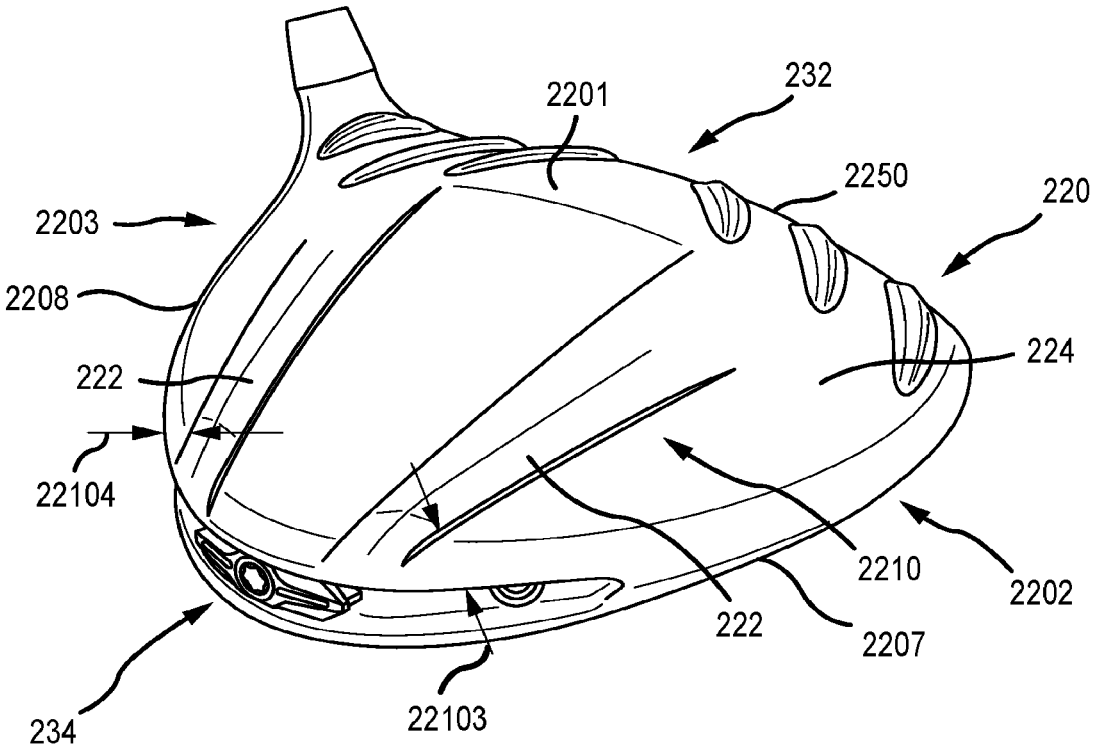
FIG. 27 illustrates a rear perspective view of the golf club head of FIG. 26.
Figure 28:
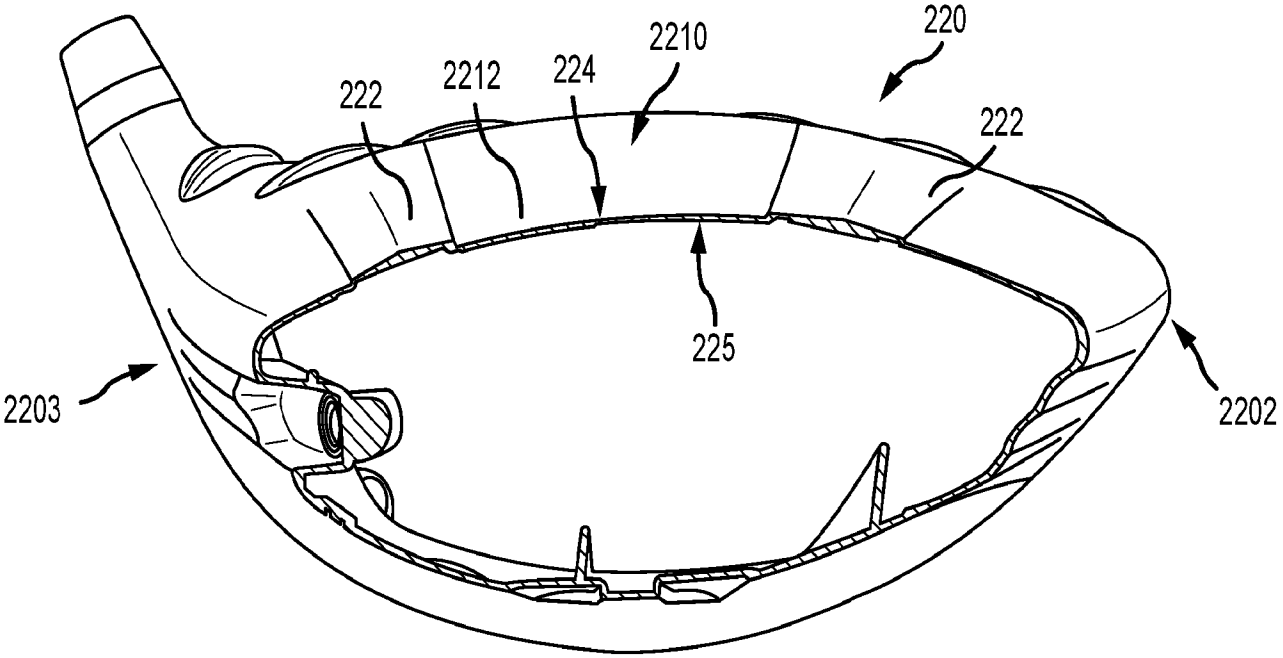
FIG. 28 illustrates a cross-section rear view of the golf club head of FIG. 26.

As illustrated in FIG. 27, the golf club head 220 can further comprise a toe club head edge 2207 and a heel club head edge 2208. The toe club head edge 2207 can be defined along a perimeter of the toe portion 2202. The heel club head edge 2208 can be defined along a perimeter of the heel portion 2203. A toe side rear distance 22103 can be measured from the toe club head edge 2207 to the external rib 222. A heel side rear distance 22104 can be measured from the heel club head edge 2208 to the external rib 222. In many embodiments, the toe side rear distance 22103 and/or the heel side rear distance 22104 can vary in a direction from the back end 234 to the front end 232. In some embodiments, the toe side rear distance 22103 and/or the heel side rear distance 22104 can be constant in a direction from the back end 234 to the front end 232. In other embodiments, the toe side rear distance 22103 and/or heel side rear distance 22104 can increase or decrease in a direction from the back end 234 to the front end 232. In many embodiments, the toe side rear distance 22103 and/or the heel side rear distance 22104 can range from 0.1 inch to 2.0 inch. In some embodiments, the toe side rear distance 22103 and/or the heel side rear distance 22104 can range from 0.1 inch to 1.0 inch, or 1.0 inch to 2.0 inches. In some embodiments, the toe side rear distance 22103 and/or the heel side rear distance 22104 can range from 0.1 inch to 0.5 inch, 0.5 inch to 1.0 inch, 1.0 inch to 1.5 inches, or 1.5 inches to 2.0 inches. For example, the toe side rear distance 22103 and/or the heel side rear distance 22104 can be 0.1, 0.2, 0.3, 0.4, 0.5, 0.6, 0.7, 0.8, 0.9, 1.0, 1.1, 1.2, 1.5, or 2.0 inches. As illustrated in FIGS. 26 and 27, the toe side rear distance 22103 and the heel side rear distance 22104 can increase in a direction from the back end 234 to the front end 232.

The external ribs 222 can comprise a length measured in a direction generally extending from near the front end 232 to near the back end 234 of the club head 220. In many embodiments, the length of the external ribs 222 can comprise at least 50% of the length of the club head 220 from the front end 232 to the back end 234. In some embodiments, the length of the external ribs 222 can comprise at least 20%, 25%, 30%, 35%, 40%, 45%, 50%, 55%, 60%, 65%, 70%, or 75% of the length of the club head 220 from the front end 232 to the back end 234. Further, in many embodiments, the external ribs 222 can be positioned on the back 50% of the length of the club head 220 from the front end 232 to the back end 234. In some embodiments, the external ribs 222 can be positioned on the back 10%, 20%, 30%, or 40% of the length of the club head 220 from the front end 232 to the back end 234. In other embodiments, the length of the external ribs 222 can comprise 10% to 80% of the length of the club head 220. In some embodiments, the length of the external ribs 222 can comprise 10% to 40%, or 40% to 80% of the length of the club head 220. In some embodiments, the length of the external ribs 222 can comprise 10% to 40%, 20% to 50%, 30% to 60%, 40% to 70%, or 50% to 80% of the length of the club head 220. In other embodiments, the external ribs 222 can be positioned anywhere on the crown 2201 of the club head 220. For example, in other embodiments, the external ribs 222 can extend along any portion of the crown 2201 of the club head 220 from the front end 232 to the back end 234 of the club head 220.

The external ribs 222 further comprise a width 226. The width 226 of the external ribs 222 can be measured in a direction extending generally from near the heel portion 2203 to near the toe portion 2202. In many embodiments, the width 226 of the external ribs 222 can be greater near the front end 232 than near the back end 234. In other embodiments, the width 226 of the external ribs 222 can be greater near the back end 234 than near the front end 232. In many embodiments, the width 226 of the external ribs 222 can increase from near the back end 234 to near the front end 232 of the club head 220. In some embodiments, the width 226 of the external ribs can decrease from near the back end 234 to near the front end 232 of the club head 220. In other embodiments, the width 226 of the external ribs 222 can remain constant, or the width 226 of the external ribs 222 can vary according to any profile along the length of the external ribs 222. In many embodiments, the width 226 at any point along the length of the external ribs 222 can range from 2.54 mm (0.1 inch) to 38.1 mm (1.5 inches). In some embodiments, the width 226 at any point along the length of the external ribs 222 can range from 2.54 mm (0.1 inch) to 25.4 mm (1.0 inch), or 25.4 mm (1.0 inch) to 38.1 mm (1.5 inches). In some embodiments, the width 226 at any point along the length of the external ribs 222 can range from 2.54 mm (0.1 inch) to 12.7 mm (0.5 inch), 5.08 mm (0.2 inch) to 20.32 mm (0.8 inch), 5.08 mm (0.2 inch) to 25.4 (1.0 inch), 7.62 mm (0.3 inch) to 22.86 mm (0.9 inch), 12.7 mm (0.5 inch) to 25.4 mm (1.0 inch), or 25.4 mm (1.0 inch) to 38.1 mm (1.5 inches). For example, the width 226 at any point along the length of the external ribs 222 can be 2.54 mm (0.1 inch), 7.62 mm (0.3 inch), 15.24 mm (0.6 inch), 22.86 mm (0.9 inch), 30.48 mm (1.2 inch), or 38.1 mm (1.5 inches).

The external ribs 222 further comprise a height. The height of the external ribs 222 can be measured as the distance the external ribs 222 protrude from the ribbed wall exterior surface 224 of the crown 2201. In many embodiments, the height of the external ribs 222 can decrease from near the back end 234 to near the front end 232 of the club head 220. In some embodiments, the height of the external ribs 222 can increase from near the back end 234 to near the front end 232 of the club head 220. Further, the height of the external ribs 222 can remain constant or can vary according to any profile along the length or width of the external ribs 222.

The external ribs 222 can be positioned at an angle to the faceplate 2250, such that the external ribs 222 converge near the back end 234 of the club head 220. In many embodiments, the external ribs 222 do not intersect each other within the golf club head 220. In other embodiments, the external ribs 222 can intersect each other within the golf club head 220. The external ribs 222 can include a first external rib 222 positioned offset from the geometric center of the faceplate 2250 toward the toe portion 2202, and a second external rib 222 positioned offset from the geometric center of the faceplate 2250 toward the heel portion 2203. The first external rib 222 can comprise a first, first external rib endpoint 242, a second, first external rib endpoint 244, and a first external rib axis 240 extending through the first, first external rib endpoint 242 and the second, first external rib endpoint 244. Similarly, the second external rib 222 can comprise a first, second external rib endpoint 242, a second, second external rib endpoint 244, and a second external rib axis 240 extending through the first, second external rib endpoint 242 and the second, second external rib endpoint 244. In many embodiments, the first and second external rib axes 240 can intersect within the golf club head 220 or external to the golf club head 220, rearward the face plate 2250. In some embodiments, as illustrated in FIG. 26, the first and second external rib axes 240 can intersect at a common point 241 within the golf club head 220 or external to the golf club head 220, rearward of the faceplate 2250.

Figure 29:
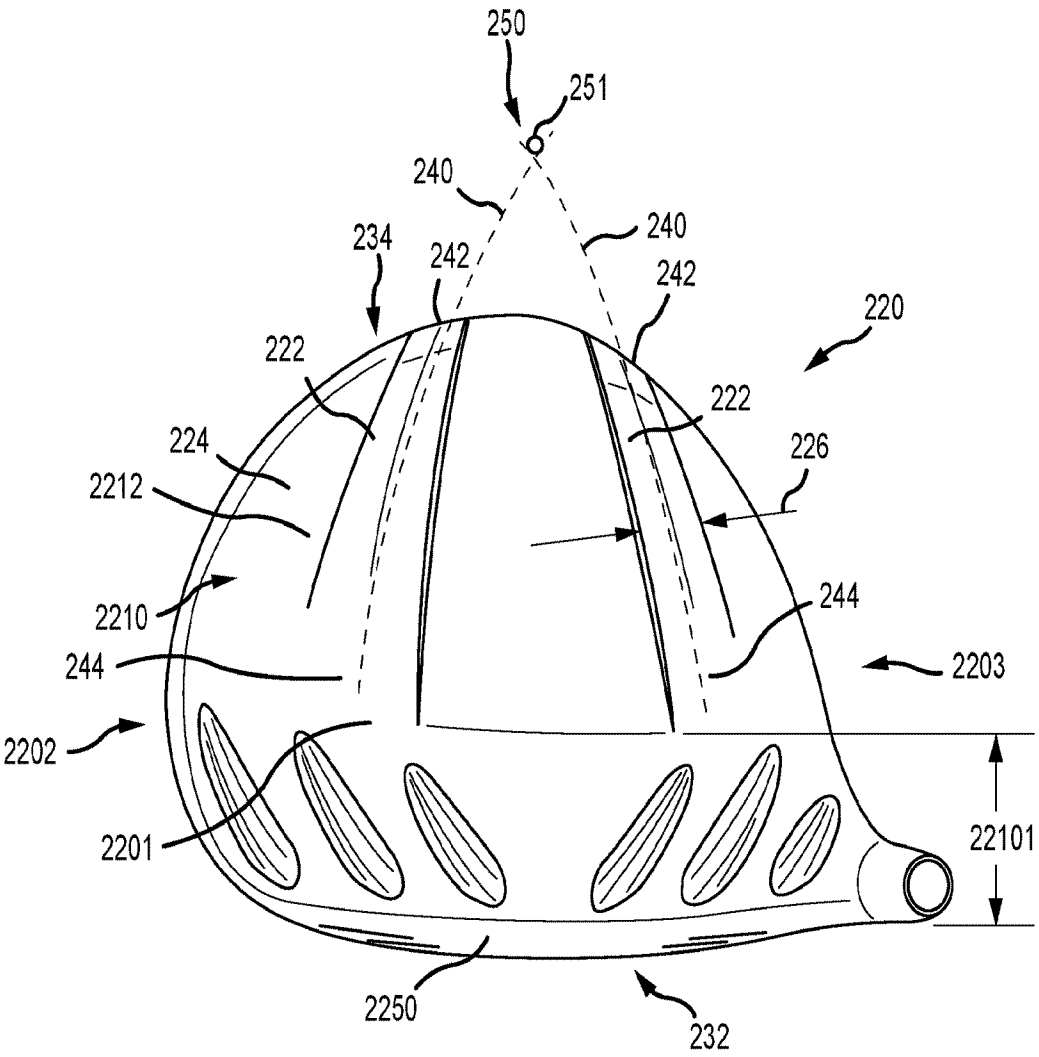
FIG. 29 illustrates a top view of another example of the golf club head comprising ribbed regions.
Figure 30:
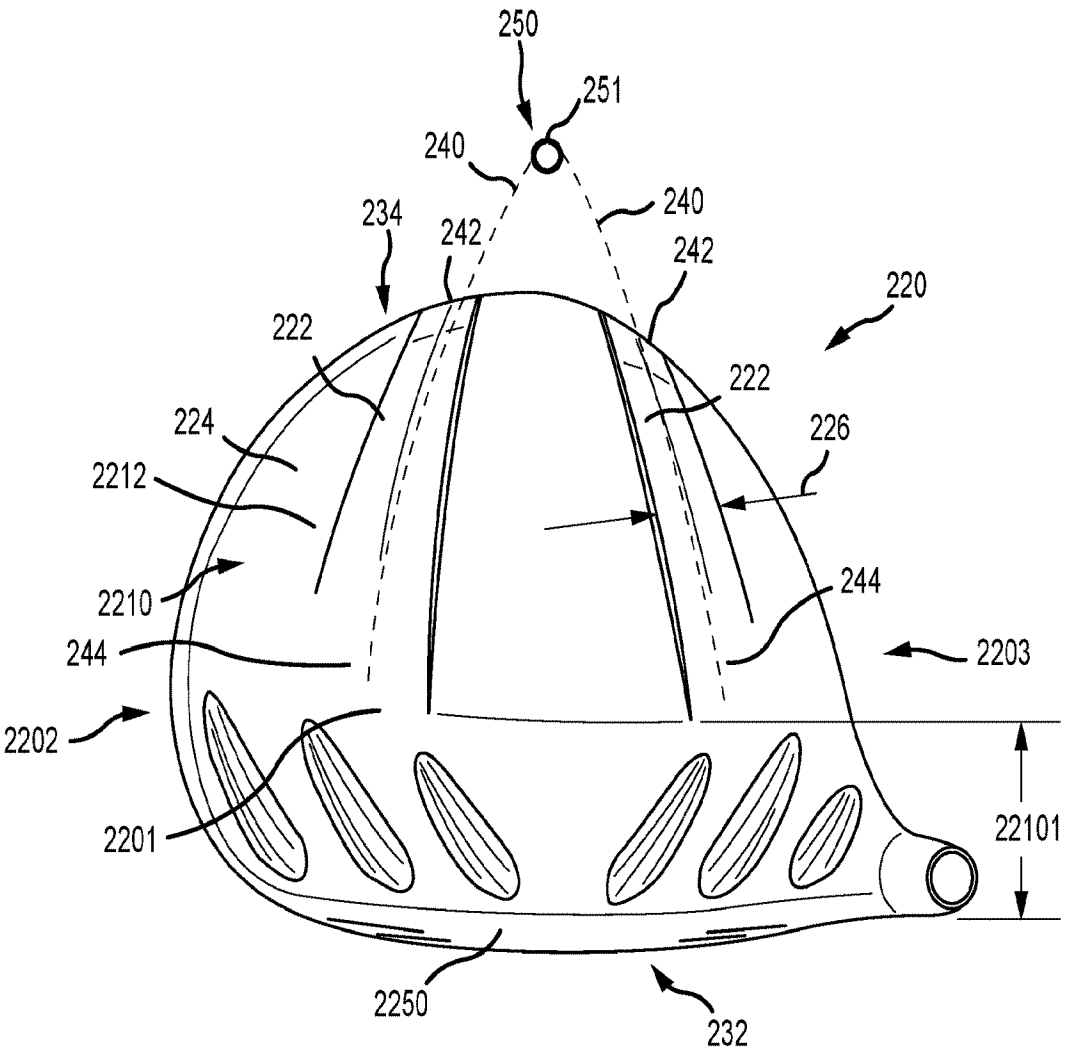
FIG. 30 illustrates a top view of another example of the golf club head comprising ribbed regions.

In other embodiments, as illustrated in FIG. 29, with respect to a top view of the golf club head 220, the external rib axes 240 intersect each other and are tangent to a locus 250 defined by a conic section perimeter 251 external to the golf club head 220, rearward of the faceplate 2250. In other embodiments, as illustrated in FIG. 30, the external rib axes 240 do not intersect each other and are tangent to a locus 250 defined by a conic section perimeter 251 external to the golf club head 220, rearward of the faceplate 2250. The conic section perimeter can extend in a direction orthogonal to a ground plane when the golf club head 220 is at an address position, and the locus 250 can comprise an area or a volume bounded by the conic section perimeter 251. Conic section perimeter 251 can comprise a circular perimeter. In other embodiments, the conic section perimeter 251 can comprise a semi-circular perimeter, an elliptical perimeter, a semi-elliptical perimeter, a parabolic perimeter, or a hyperbolic perimeter.

In many embodiments, a distance between the external ribs 222, measured in a generally heel portion 2203 to toe portion 2202 direction, can decrease from near the front end 232 to near the back end 234 of the club head 220. In some embodiments, the distance between the external ribs 222 can increase from near the front end 232 to near the back end 234 of the club head 220. The first and second external ribs 222 can be symmetric about a plane extending through the geometric center of the faceplate 2250 from the front end 232 to the back end 234 of the club head 220. In other embodiments, the first and second external ribs 22 can be asymmetric about the plane extending through the geometric center of the face plate 2250 from the front end 232 to the back end 234 of the club head 220.

Accordingly, the external ribs 222 can assist a golfer in aligning a golf ball with the center of the faceplate 2250 at the address position and during impact. The angle of the external ribs 222 to the faceplate 2250 further provides a converging runway visual aid allowing the golfer to easily align the golf ball with the center of the faceplate 2250 during the address position and during impact. Further, in many embodiments, the external ribs 222 on the crown 2201 of the golf club head 220 provide structural reinforcement to the crown 2201 during impact with a golf ball. The angle of the external ribs 222 to the faceplate 2250 further provides structural reinforcement to the crown 2201 by allowing the larger thickness of the external ribs 222 to converge to the thinnest areas of the crown 2201 generally located at a center of the crown 2201. More specifically, the external ribs 222 on the crown 2201 of the club head 220 provides dent resistance from the resonant forces during golf ball impacts. The external ribs 222 provide a greater thickness on the crown 2201 in portions where the club head 220 is susceptible to large resonant forces. Increasing the crown 2201 thickness with the external ribs 222 in portions where the large resonant forces occur allows the crown 2201 to be thinned while preventing denting of the crown 2201 during golf ball impacts. Further, in many embodiments, the external ribs 222 on the crown 2201 of the club head 220 provide improved acoustic properties during impact with a golf ball.

The crown 2201 or ribbed wall 2212 of the club head 220 can further include a thickness that is less than the thickness of current hollow body, wood-type club heads. In many embodiments, the thickness of the crown 2201 or ribbed wall 2212 can range between 0.012 to 0.035 inch (0.305 to 0.890 mm). In other embodiments, the thickness of the crown 2201 or ribbed wall 2212 can be less than 0.035 inch (0.890 mm), less than 0.031 inch (0.8 mm), less than 0.03 inch (0.762 mm), less than 0.025 (0.635 mm), less than 0.02 (0.508 mm), or less than 0.015 inch (0.381 mm). The thickness of the crown 2201 can remain constant, or the thickness can vary in different regions of the crown 2201.

In these or other embodiments, the thickness of the crown 2201 can vary from near the front end 232 to near the back end 234, from near the heel portion 2203 to near the toe portion 2202, or in any direction along the crown 2201 of the club head 220. In some embodiments, the thickness of the crown 2201 can decrease from near the front end 232 toward the back end 234 of the club head 220 in sections extending from the heel portion 2203 to the toe portion 2202. For example, the thickness of the crown 2201 in the front ⅓ of the length of the club head 220 from the front end 232 to the rear end 234 can be between 0.025 inch (0.635 mm) and 0.035 inch (0.890 mm), the thickness of the crown 2201 in the central ⅓ of the length of the club head 220 from the front end 232 to the back end 234 can be between 0.020 inch (0.508 mm) and 0.030 inch (0.762 mm), and the thickness of the crown 2201 in the rear ⅓ of the length of the club head 220 from the front end 232 to the back end 234 can be between 0.012 inch (0.305 mm) and 0.025 inch (0.635 mm).

In these embodiments, the thickness of the crown 2201 can decrease gradually, can decrease with one or more steps, or can decrease according to any profile from near the front end 232 toward the back end 234 of the club head 220. In these embodiments, the thickness at a given location of the crown 2201 can correspond to the stress experienced by that location of the crown 2201 during impact. Typically, the stress experienced by the crown 2201 near the front end 232 of the club head 220 is higher than the stress experienced by the crown 2201 near the back end 234 of the club head 220 on impact with a golf ball. Increasing the thickness of the crown 2201 with wider external ribs near the front end 232 of the club head 220 further increases the structural rigidity near the front end 232 thereby reducing stresses in the crown 2201 on impact with the golf ball. Accordingly, the thickness can be low near the back end 234 of the club head 220, to reduce club head weight in regions of the club head 220 where durability is not a concern due to lower impact stress. Accordingly, weight savings or weight repositioning can be achieved by reducing the thickness in regions near the back end 234 of the club head 220 to improve the club head center of gravity position (i.e. low and back) and/or increase club head moment of inertia, without sacrificing club head durability.

In some embodiments, the thickness (i.e. distance the ribbed region 2210 protrudes from the crown 2201) of the ribbed region 2210 can vary between portions of the ribbed wall 2212 comprising the external ribs 222 and portions of the ribbed wall 2212 devoid of the external ribs 222. For example, the thickness of the ribbed wall 2212 at the external ribs 222 can be the same as or similar to the thickness of the ribbed wall 2212 adjacent to the external ribs 222. In these embodiments, the internal contour of a ribbed wall interior surface 225 changes in accordance with the ribbed wall exterior surface 224 to maintain a similar thickness of the ribbed wall 2212 along the external ribs 222 as adjacent to the external ribs 222. For further example, the thickness of the ribbed wall 2212 at the external ribs 222 (or at least a portion of the external ribs 222) can be greater than the thickness of the ribbed wall 2212 in regions devoid of the external ribs 222. In these embodiments, the internal contour of the ribbed wall interior surface 225 can remain substantially smooth or constant from a location at the external ribs 222 to a location adjacent the external ribs 222. Further, the thickness of the ribbed wall 2212 can vary along the length or width 226 of the external ribs 222, as illustrated in FIG.

28, where the thickness of the ribbed wall 2212 can be greatest at the center of the width 226 of the external ribs 222.

Figure 13:
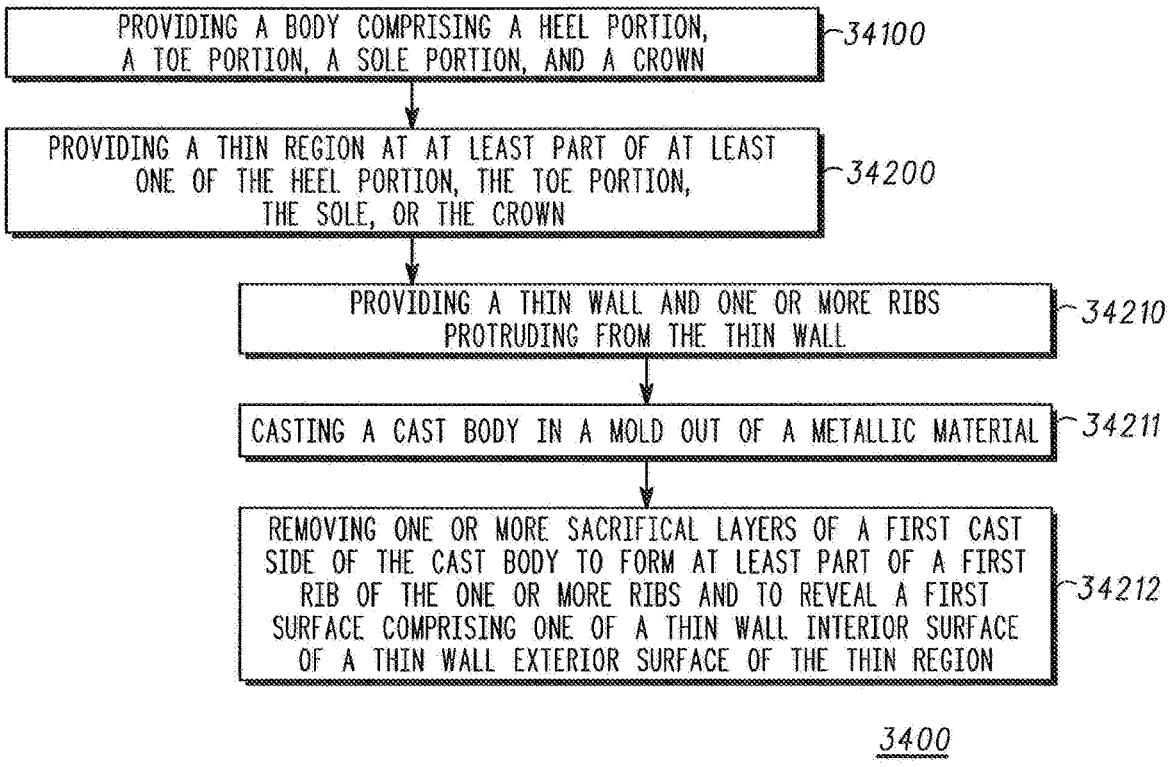
FIG. 13 illustrates a flowchart of a method for providing a golf club head in accordance with examples and embodiments of the present disclosure.

FIG. 13 illustrates a flowchart of a method 34000 for providing a golf club head. In some examples, the golf club head can be similar to one or more of the golf club heads previously described, such as golf club head 220, golf club heads with one or more of the ribbed regions or ribs described above, and/or variations thereof.

Block 34100 of method 34000 involves providing a body comprising a heel portion, a toe portion, a sole, and a crown. In some examples, the body and/or the heel portion, the toe portion, the sole, or the crown can be similar to those of the one or more golf club heads described herein.

Block 34200 of method 34000 comprises providing a ribbed region at least part of at least one of the heel portion, the toe portion, the sole, or the crown of block 34100. In some examples, the ribbed region can be similar to one or more of ribbed region 2210 (FIG. 1), ribbed region 2320 (FIG. 2), ribbed region 2330 (FIG. 2), ribbed region 260, ribbed region 280, ribbed region 300 and/or ribbed region 320.

Block 34200 can comprise block 34210 in some examples, where block 34210 comprises providing a ribbed wall and one or more ribs protruding from the ribbed wall. In some embodiments, the ribbed wall can be similar to ribbed wall 2212, and/or can be similar to ribbed wall 265. In the same or other embodiments, the one or more ribs can be similar to one or more of ribs 2211 (FIG. 1), ribs 2321 (FIG. 2), or ribs 2331 (FIG. 2), and/or can be similar to rib 261, rib 281, rib 301, or rib 321.

Figure 14:
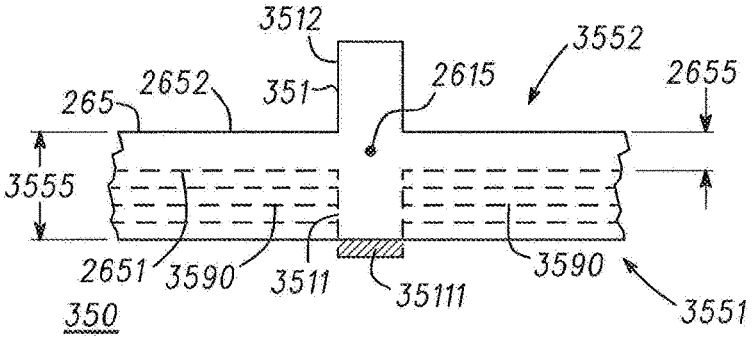
FIG. 14 illustrates a transverse cross-sectional view of a cast body that can be used to form a golf club head ribbed region similar to one or more of the ribbed regions of FIGS. 1-13.

In some examples, providing the ribbed wall and the one or more ribs in block 34210 can be accomplished via blocks 34211 and 34212. Block 34211 comprises casting a cast body in a mold out of a metallic material. FIG. 14 illustrates a transverse cross-sectional view of cast body 350, which can be similar to the cast body of block 34211 of method 34000, and which can be used to form ribbed regions similar to one or more of ribbed region 2210 (FIG. 1), ribbed region 2320 (FIG. 2), ribbed region 2330 (FIG. 2), ribbed region 260, ribbed region 280, ribbed region 300 and/or ribbed region 320. In some examples, a metallic material of cast body 350 can comprise a titanium material. Cast body 350 comprises cast side 3551 and cast side 3552 opposite cast side 3551.

In the present example, cast side 3552 comprises rib exterior section 3512 of rib 351, which can be similar to one or more of the rib exterior sections of the ribs, such as rib exterior section 2612 of rib 261. Cast side 3552 also comprises ribbed wall exterior surface 2652 of ribbed wall 265. Rib exterior section 3512 and/or ribbed wall exterior surface 2652 can be directly cast via a casting mold during the casting of cast body 350, but can also be formed in a manner similar to the following description for the formation of rib interior section 3511 and ribbed wall interior surface 2651.

Block 34212 of method 34000 (FIG. 13) comprises removing one or more sacrificial layers of a first cast side of the cast body to form at least part of a first rib of the one or more ribs and to reveal a first surface comprising one of a ribbed wall interior surface or a ribbed wall exterior surface of the ribbed region. With respect to the example of FIG. 14, the first cast side can be similar to side 3551 of cast body 350, the one or more sacrificial layers can be similar to one or more sacrificial layers 3590, the part of the first rib can be similar to at least part of rib interior section 3511 of rib 351, and the first surface can be similar to ribbed wall interior surface 2651. In another example, the first cast side can be similar to cast side 3552, the part of the first rib can be similar to at least part of rib exterior section 3512 of rib 351, and the first surface can be similar to ribbed wall exterior surface 2652.

In block 34212 (FIG. 13), removing the one or more sacrificial layers of the first cast side can be carried out via a chemical etch process. With respect to the example of FIG. 14, mask 35111 can be applied to the outer edge of rib interior section 3511, and then a chemical etchant can be applied to cast side 3551 to remove sacrificial layers 3590 through to ribbed wall interior surface 2651. In some examples, mask 35111 can comprise a polyurethane paint material, a resistive film, a wax material, a tar material, a grease material, or other resistive material. In the same or other examples, the chemical etchant used for the chemical etch process can comprise, for instance, hydrofluoric acid. In one implementation, where the material of cast body 350 is a titanium material, the hydrofluoric acid chemical etchant can etch through such titanium material at a rate of approximately 0.25 mm in approximately 25 minutes. In other examples, the one or more sacrificial layers can be removed from cast body 350 by other methods, such as via machining, laser etching, electrical discharge machining, electro chemical machining and/or via abrasive polishing.

In some examples, the ability to cast a cast body like cast body 350 (FIG. 14) and then remove sacrificial layers like sacrificial layers 3590 can permit the creation of reinforced ribbed walls, like ribbed wall 265 with ribs similar to those described above, where such reinforced ribbed walls can be thinner than would otherwise be feasible via casting alone. For example, cast body 350 can comprise cast wall thickness 3555 (FIG. 14) of up to approximately 1.03 mm between cast sides 3551 and 3552 in some examples, where cast wall thickness 3555 is approximately 0.53 mm to approximately 0.64 mm in the present embodiment. Casting a wall thickness thinner than that described above for cast wall thickness 3555 can be increasingly difficult, however, as it becomes harder for molten metallic material to flow into or through narrower casting mold conduits and/or to consistently or properly fill corresponding smaller mold crevices in the casting mold. With the minimum thickness for cast wall thickness 3555 constrained by such limitations of the casting process as described above, further reduction in wall thickness can be accomplished via the sacrificial layer removal methodology described above, thus permitting the formation of ribbed wall 265 with thinner ribbed wall thickness 2655. The ability to further remove sacrificial layers such as sacrificial layers 3590 thus permits the formation of thinner and lighter ribbed regions, which can comprise reinforcement ribs as described above for structural integrity and/or durability. In addition, the removal of sacrificial layers 3590 permits the repositioning of mass to other areas of the golf club head for better performance without increasing the total mass of the golf club head.

There can be examples where different blocks of method 34000 can be combined into a single block or performed simultaneously, and/or where the sequence of such blocks can be changed. For example, block 34211 can be carried out simultaneously with block 34100 in some examples. There can also be examples where method 2000 can comprise further or different blocks. As an example, method 34000 can comprise another block for coupling a faceplate to the body of block 34100. There can be examples where method 2000 can comprise fewer blocks. For example, golf club head 220 can be manufactured by casting and block 34212 can be removed. Other variations can be implemented for method 34000 without departing from the scope of the present disclosure.

Although the golf club heads with ribs and related methods herein have been described with reference to specific embodiments, various changes may be made without departing from the spirit or scope of the present disclosure. As an example, one embodiment can comprise ribs similar to one or more of rib 261, rib 281, rib 301, and/or rib 321, where such one or more ribs can protrude only from one of ribbed wall exterior surface 2652 or ribbed wall interior surface 2651. Another example can comprise a golf club head similar to golf club head 220, but lacking at least one of ribbed region 2210 (FIG. 1), ribbed region 2320 (FIG. 2) or ribbed region 2330 (FIG. 2). Another example can comprise a golf club head similar to golf club head 220, but without sole thick region 23041 and with ribbed regions 2320 and 2330 merged together. In another example, one or both of ribbed regions 2320 and/or 2330 can be located only at skirt 2305, without extending to sole 2304.

Additional examples have been given in the foregoing description. Other permutations of the different embodiments having one or more of the features of the various figures are likewise contemplated. Accordingly, the disclosure herein is intended to be illustrative and is not intended to be limiting. It is intended that the scope of this application shall be limited only to the extent required by the appended claims.

The golf club heads with ribs and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
- a front end;
- a back end opposite the front end;
- a heel portion;
- a toe portion opposite the heel portion;
- a sole;
- a crown opposite the sole having a length;
- a faceplate having a top; and
- a ribbed region positioned on a portion of the crown; wherein the ribbed region comprises:
  - a ribbed wall comprising:
  - a ribbed wall interior surface facing an interior of the golf club head;
  - a ribbed wall exterior surface facing an exterior of the golf club head opposite the ribbed wall interior surface; and
  - a thickness measured from the ribbed wall interior surface to the ribbed wall exterior surface that is less than 0.031 inch;
  - one or more external ribs protruding from the ribbed wall exterior surface, wherein the one or more external ribs extend from the back end toward the front end of the golf club head in the ribbed region;
  - the one or more external ribs comprise a first external rib having:
    - a first, first external rib endpoint; and
    - a second, first external rib endpoint; and
  - the one or more external ribs further comprise a second external rib having:
    - a first, second external rib endpoint; and
    - a second, second external rib endpoint;
    - a second external rib axis intersecting the first, second external rib endpoint and the second, second external rib endpoint;
    - wherein:
    - the one or more ribs comprises an external rib height, wherein the external rib height decreases from the back end to the front end of the golf club head;
      - the length of the crown extends from the front end to the back end direction;
      - the crown of the golf club head includes a front portion, a middle portion, and a rear portion, each comprising a length that is ⅓ the length of the crown;
      - wherein the crown has a thickness in each of the front portion, the middle portion, and the rear portion;
      - wherein:
      - the front portion of the crown is proximal to the faceplate;
      - the rear portion of the crown is proximal to the back end;
      - the middle portion of the crown is between the rear portion and the front portion; and
      - the front portion thickness is less than 0.035 inch.

2. The golf club head of claim 1, wherein:
the thickness of the front portion of the crown is greater than the thickness of the middle portion and rear portion of the crown.

3. The golf club head of claim 2, wherein:
an entire middle portion has a thickness less than or equal to 0.020 inch.

4. The golf club head of claim 1, wherein:
the one or more external ribs is positioned in a rear 50% of a length of the golf club head from the front end to the back end.

5. The golf club head of claim 2, wherein:
an entire rear portion has a thickness less than or equal to 0.020 inch.

6. The golf club head of claim 1, wherein:
a front distance measured from the top of the faceplate to the ribbed region is between 0.5 inch and 3.00 inch, the front distance configured to control resonant forces during impact.

7. The golf club head of claim 1, wherein:
a heel side rear distance measured from a heel club head edge to the ribbed region, wherein the heel club head edge is defined along a perimeter of the heel portion; wherein the heel side rear distance varies along the heel portion such that the one or more external ribs extending from the back toward the front is curved.

8. The golf club head of claim 1, wherein:
a toe side rear distance measured from a toe club head edge to the ribbed region, wherein the toe club head edge is defined along a perimeter of the toe portion; wherein the toe side rear distance varies along the toe portion such that the one or more external ribs extending from the back toward the front is curved.

9. The golf club head of claim 1, wherein:
the one or more external ribs comprises:
a longitudinal edge extending in a direction from the back end to the front end of the golf club head;
a lateral edge extending in a direction from the toe portion to the heel portion of the golf club head;
wherein:
an obtuse angle is defined between the longitudinal edges and the lateral edge of the one or more external ribs.

10. The golf club head of claim 1, wherein:
at least one of the one or more external ribs comprise an external rib width, where the external rib width increases from the back end to the front end of the golf club head.

11. The golf club head of claim 1, wherein:
the thickness of the front portion varies from the heel end to the toe end.

12. A golf club head comprising:
a front end;
a back end opposite the front end;
a heel portion;
a toe portion opposite the heel portion;
a sole;
a crown opposite the sole having a length;
a faceplate having a top; and
a ribbed region positioned on a portion of the crown, the ribbed region comprising:
a ribbed wall comprising:
a ribbed wall interior surface facing an interior of the golf club head;
a ribbed wall exterior surface facing an exterior of the golf club head opposite the ribbed wall interior surface:
a thickness measured from the ribbed wall interior surface to the ribbed wall exterior surface that is less than 0.031 inch; and
a front distance measured from the top of the faceplate to the ribbed region;
wherein the front distance varies from the heel portion to the toe portion;
one or more external ribs protruding from the ribbed wall exterior surface, wherein the one or more external ribs extend from the back end toward the front end of the golf club head in the ribbed region;
the one or more external ribs comprise a first external rib having:
a first, first external rib endpoint;
a second, first external rib endpoint; and
the one or more external ribs further comprise a second external rib having:
a first, second external rib endpoint;
a second, second external rib endpoint; and
the one or more external ribs comprises an external rib height, wherein the external rib height decreases from the back end to the front end of the golf club head;
wherein:
the length of the crown extends from the front end to the back end direction;
the crown of the golf club head further includes a front portion, a middle portion, and a rear portion; wherein each of the front portion, middle portion, and rear portion comprise:
a length that is ⅓ the length of the crown; and
a thickness;
wherein:
the front portion of the crown is proximal to the faceplate;
the rear portion of the crown is proximal to the back;
the middle portion of the crown is between the rear portion and the front portion; and
the thickness of the front portion is greater than the thickness of the middle portion and the thickness of the rear portion.

13. The golf club head of claim 12, wherein:
the first external rib and the second external rib are positioned in a rear 50% of a length of the golf club head from the front end to the back end.

14. The golf club head of claim 12, wherein:
the thickness of the front portion is less than 0.035 inch.

15. The golf club head of claim 12, wherein:
a heel side rear distance measured from a heel club head edge to the ribbed region, wherein the heel club head edge is defined along a perimeter of the heel portion; wherein the heel side rear distance varies along the heel portion, such that the one or more external rib extending from the back toward the front is curved.

16. The golf club head of claim 12, wherein:
a toe side rear distance measured from a toe club head edge to the ribbed region, wherein the toe club head edge is defined along a perimeter of the toe portion; wherein the toe side rear distance varies along the toe portion, such that the one or more external ribs extending from the back toward the front is curved.

17. The golf club head of claim 12, wherein:

the front distance increases from the toe portion to a center of the crown and decreases from the center of the crown to the heel portion.

18. The golf club head of claim 12, wherein:

an entire middle portion of the crown has a thickness less than or equal to 0.020 inch.

19. The golf club head of claim 12, wherein:

the one or more external ribs further comprise a third external rib and a fourth external rib.

20. The golf club head of claim 12, wherein:

an entire rear portion has a thickness less than or equal to 0.020 inch.

* * * * *